US010685525B2

(12) United States Patent
Fujii

(10) Patent No.: US 10,685,525 B2
(45) Date of Patent: Jun. 16, 2020

(54) MONEY HANDLING APPARATUS FOR COMMERCIAL FACILITIES

(71) Applicant: GLORY LTD., Himeji-shi, Hyogo (JP)

(72) Inventor: Takahisa Fujii, Himeji (JP)

(73) Assignee: GLORY LTD., Himeji-shi (JP)

( * ) Notice: Subject to any disclaimer, the term of this patent is extended or adjusted under 35 U.S.C. 154(b) by 0 days.

(21) Appl. No.: 16/085,091

(22) PCT Filed: Jan. 12, 2017

(86) PCT No.: PCT/JP2017/000811
§ 371 (c)(1),
(2) Date: Sep. 14, 2018

(87) PCT Pub. No.: WO2017/159013
PCT Pub. Date: Sep. 21, 2017

(65) Prior Publication Data

US 2019/0088067 A1 Mar. 21, 2019

(30) Foreign Application Priority Data

Mar. 18, 2016 (JP) ..... 2016-054772

(51) Int. Cl.
*G07D 9/00* (2006.01)
*G07D 11/00* (2019.01)
*G07D 11/235* (2019.01)
*G07D 11/24* (2019.01)
(Continued)

(52) U.S. Cl.
CPC ..... *G07D 11/34* (2019.01); *G07D 9/00* (2013.01); *G07D 11/0087* (2013.01);
(Continued)

(58) Field of Classification Search
CPC .... G07D 9/00; G07D 11/0087; G07D 11/235; G07D 11/24; G07D 11/30; G07D 11/34
(Continued)

(56) References Cited

U.S. PATENT DOCUMENTS 8,701,857 B2 * 4/2014 Jenrick ..... G07D 7/00 194/206
8,746,551 B2 * 6/2014 Bryant ..... G06F 11/008 235/379
(Continued)

FOREIGN PATENT DOCUMENTS

EP 2 555 171 A1 2/2013
JP 2005-222336 A 8/2005
(Continued)

OTHER PUBLICATIONS

Extended European Search Report, Application No. 17766021.4, dated Oct. 14, 2019, 7 pages.
(Continued)

*Primary Examiner* — Toan C Ly
(74) *Attorney, Agent, or Firm* — Foley & Lardner LLP

(57) ABSTRACT

A money handling apparatus (for example, money depositing and dispensing machine 100) includes a state detector 107 configured to detect a state of another money handling apparatus (for example, money change machine 200) to which the storage cassette (for example, banknote storage cassette 300) has previously been mounted or a state of the storage cassette itself and a determiner 108 configured to determine whether a counter (for example, recognizer 132) counts the money taken out from the storage cassette, based on the state detected by the state detector.

12 Claims, 13 Drawing Sheets

(51) Int. Cl.
*G07D 11/30* (2019.01)
*G07D 11/34* (2019.01)
*G07D 11/245* (2019.01)

(52) U.S. Cl.
CPC ..... *G07D 11/235* (2019.01); *G07D 11/24* (2019.01); *G07D 11/245* (2019.01); *G07D 11/30* (2019.01)

(58) Field of Classification Search
USPC ..... 235/379
See application file for complete search history.

(56) References Cited

U.S. PATENT DOCUMENTS

| | | | | |
|---|---|---|---|---|
| 2005/0173515 | A1 | 8/2005 | Sawa | |
| 2008/0237335 | A1 | 10/2008 | Sawa | |
| 2013/0205723 | A1* | 8/2013 | Blake | G07F 9/08 53/473 |

FOREIGN PATENT DOCUMENTS

| | | | |
|---|---|---|---|
| JP | 2006-342540 | A | 12/2006 |
| JP | 5125136 | B2 | 1/2013 |

OTHER PUBLICATIONS

Japanese Office Action and English translation, Application No. 2016-054772, dated Sep. 26, 2019, 10 pages.
Japanese Office Action and English translation, Application No. 2016-054772, Mar. 2, 2020, 7 pages.

* cited by examiner

MONEY HANDLING APPARATUS FOR COMMERCIAL FACILITIES

TECHNICAL FIELD

The present invention relates to a money handling apparatus for performing at least money depositing of coin, a money management system including such a money handling apparatus, and a money handling method conducted by such a money handling apparatus.

BACKGROUND ART

In stores of commercial facilities such as supermarkets and convenience stores, a money change machine is installed in a settlement place in a front region where store shelves are arranged, and a depositing/dispensing machine such as a cashier machine is installed in a back office region which customers are not allowed to enter. The money change machine installed in the settlement place in the front region can perform depositing of money delivered for a commodity from a customer to a clerk, and can perform dispensing of money as change. Furthermore, the depositing/dispensing machine, such as a cashier machine, installed in the back office region performs depositing of money collected from the money change machine as proceeds from sales, and performs dispensing of money with which the money change machine is to be replenished as change replenishment money.

To date, various types of money management systems in each of which the money change machine installed in the front region and the depositing/dispensing machine installed in the back office region are combined with each other, have been used. For example, Japanese Patent No. 5125136 discloses a cash management system that includes at least one money change machine, a cash handling device that performs depositing of money collected from the money change machine, and a cash data management device that manages information on an inventory amount of money for each denomination as change which is stored in the money change machine, information on a necessary amount of money for each denomination as change being in the money change machine, and information on a deposited monetary amount in the cash handling device. In such a cash management system, the cash data management device notifies the cash handling device of information on the number of money for each denomination as change replenishment money, with which the money change machine is to be replenished, on the basis of an inventory amount data transmitted from the money change machine, and the cash handling device dispenses money as change replenishment money with which the money change machine is to be replenished, on the basis of the information of which notification is made by the cash data management device. Furthermore, when money is collected from the money change machine as proceeds from sales, the cash data management device calculates, for example, a number of money and a monetary amount of money, for each denomination, to be collected from the money change machine, on the basis of an inventory amount of money in the money change machine and the necessary specific change money (that is, information on a number of money for each denomination to be left in the money change machine as change), and notifies the money change machine of the information obtained by the calculation. The money change machine dispenses money to be collected, on the basis of the information of which the notification has been made by the cash data management device.

SUMMARY OF THE INVENTION

However, the conventional money management system as disclosed in Japanese Patent No. 5125136 has a problem that the cash data management device is necessary and the cost for installation and the cost for maintenance are increased in the entirety of the system. Furthermore, in a case where a plurality of the money change machines is disposed, another money change machine different from the money change machine to be replenished with money dispensed from the cash handling device as change may be replenished with the dispensed money by mistake.

Further, in an example of another money management system, a banknote storage cassette is detachably mounted to the money change machine installed in the front region and the money depositing and dispensing machine installed in the back office region, respectively. In such a money management system, in order to deposit banknotes collected from the money change machine to the money depositing and dispensing machine, the banknote storage cassette is first mounted to the money change machine, and then the banknotes to be collected are stored in the banknote storage cassette. Thereafter, the banknote storage cassette is transferred from the front region to the back office region. Further, in such a money management system, if a storage medium in which information on the banknotes stored in the banknote storage cassette is recorded is disposed at the banknote storage cassette, information on the banknotes collected from the money change machine can be managed by the money depositing and dispensing machine. However, conventionally, even when the information of the banknotes collected from the money change machine is managed by the money depositing and dispensing machine by using the storage medium disposed at the banknote storage cassette, the banknotes taken out from the banknote storage cassette were necessarily counted in the money depositing and dispensing machine. In such a manner, even if it is not necessary to count the banknotes, there are cases where the banknotes are counted, which is a problem of poor processing efficiency.

The present invention is made in view of the aforementioned problem, and an object of the present invention is to provide a money handling apparatus, a money management system, and a money handling method capable of improving processing efficiency and reducing processing time, since when it is not necessary to count money by a counter, it is possible to omit a counting process of the money using the counter.

A money handling apparatus of the present invention includes: a storage cassette configured to store money; a storage medium disposed at the storage cassette and configured to record at least information on the money stored in the storage cassette; a mounting arrangement to which the storage cassette is mountable; a reader configured to read information from the storage medium disposed at the storage cassette mounted to the mounting arrangement; a counter configured to count the money; a state detector configured to detect a state of another money handling apparatus to which the storage cassette has previously been mounted or a state of the storage cassette itself; and a determiner configured to determine whether the counter counts the money taken out from the storage cassette, based on the state detected by the state detector.

In the money handling apparatus of the present invention, the state of the another money handling apparatus to which the storage cassette has previously been mounted or the state of the storage cassette itself may be recorded in the storage medium, and the state detector may detect the state of the another money handling apparatus to which the storage cassette has previously been mounted or the state of the storage cassette itself, based on the information read from the storage medium by the reader.

Further, the state detector may detect an abnormality of the another money handling apparatus.

In this case, the state detector may detect whether a jamming phenomenon of the money has occurred as the abnormality of the another money handling apparatus.

In the money handling apparatus of the present invention, the state detector may detect that a component of the storage cassette has been operated.

In this case, a component-operation detector may be configured to detect that the component of the storage cassette has been operated is disposed at the storage cassette, and the state detector may detect that the component of the storage cassette has been operated based on information detected by the component-operation detector.

Further, the state detector may detect operation of the component of the storage cassette when the component of the storage cassette is operated while the storage cassette is mounted to the mounting arrangement.

In the money handling apparatus of the present invention, the state detector may be operable to detect an abnormality of a writing in the storage medium or may detect that information on the money stored in the storage cassette is not recorded in the storage medium even though the money is stored in the storage cassette.

Also, the counter may include a recognizer configured to recognize the money.

A money management system of the present invention includes: a first money handling apparatus configured to perform at least money depositing; a second money handling apparatus configured to perform at least money dispensing; and a storage cassette configured to store money and configured to be detachably mounted to each of the first money handling apparatus and the second money handling apparatus, the storage cassette includes a storage medium in which at least information on the money stored in the storage cassette is recordable, and the second money handling apparatus has a reader configured to read information from the storage medium disposed at the storage cassette mounted to the second money handling apparatus; a counter configured to count the money; a state detector configured to detect a state of the first money handling apparatus or a state of the storage cassette itself; and a determiner configured to determine whether the counter counts the money taken out from the storage cassette, based on the state detected by the state detector.

In the money management system of the present invention, the state of the first money handling apparatus or the state of the storage cassette itself may be recorded in the storage medium, and the state detector may detect the state of the first money handling apparatus or the state of the storage cassette itself, based on the information read from the storage medium by the reader.

A money handling method of the present invention includes: storing money in a storage cassette configured to store the money; recording at least information on the money stored in the storage cassette in a storage medium disposed at the storage cassette; mounting the storage cassette to a mounting arrangement; reading information from the storage medium disposed at the storage cassette mounted to the mounting arrangement; detecting a state of another money handling apparatus to which the storage cassette has previously been mounted or a state of the storage cassette itself; and determining whether to count the money taken out from the storage cassette, based on the state detected by a state detector.

In the money handling method of the present invention, the state of the another money handling apparatus to which the storage cassette has previously been mounted or the state of the storage cassette itself may be recorded in the storage medium, and the state detector may detect the state of another money handling apparatus to which the storage cassette has previously been mounted or the state of the storage cassette itself, based on the information read from the storage medium by a reader.

DESCRIPTION OF THE PREFERRED EMBODIMENTS

Figure 1:
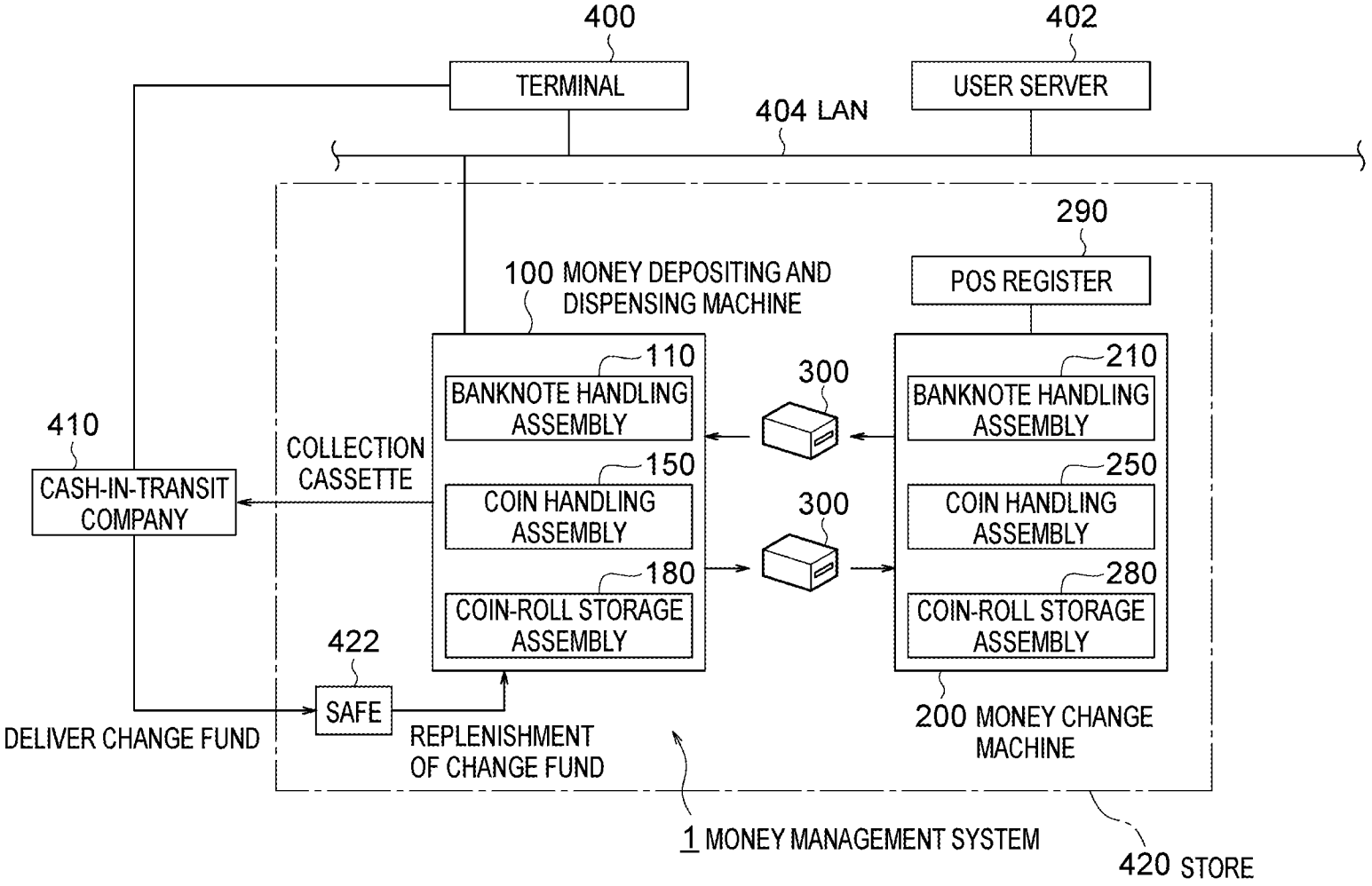
FIG. 1 schematically illustrates a configuration of a money management system according to an embodiment of the present invention.
Figure 2:
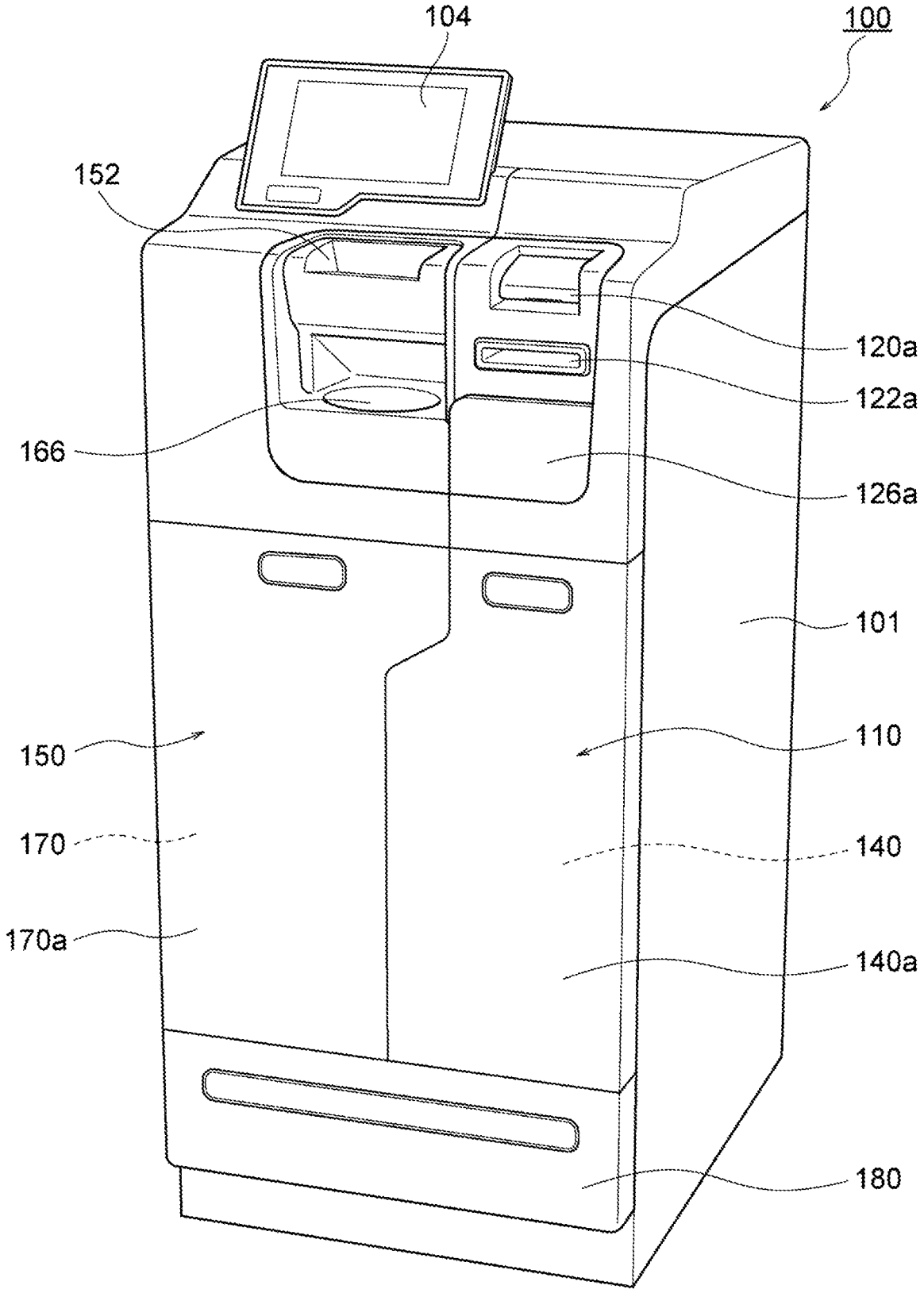
FIG. 2 is a perspective view of an outer appearance of a money depositing and dispensing machine in the money management system shown in FIG. 1.
Figure 3:
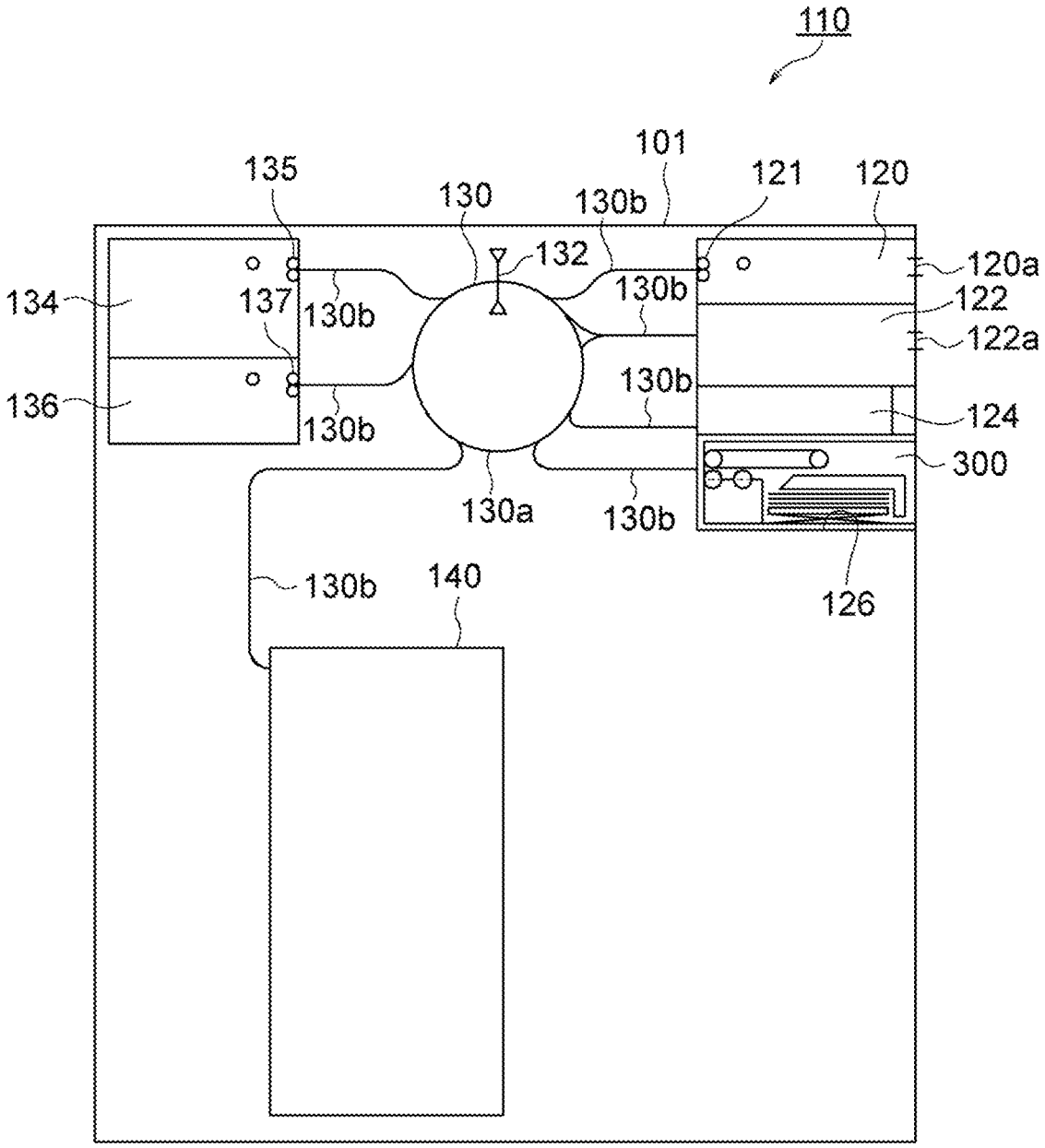
FIG. 3 illustrates an internal configuration of a banknote handling assembly in the money depositing and dispensing machine shown in FIG. 2, as viewed from the side thereof.
Figure 4:
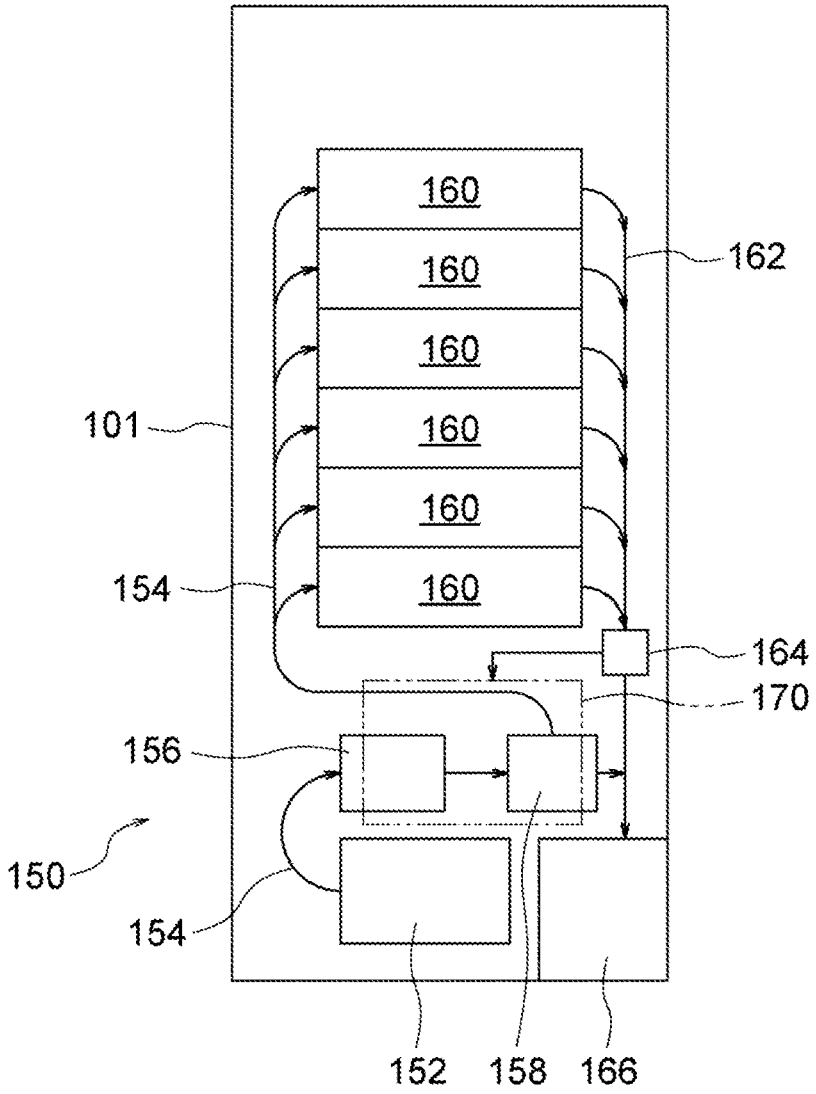
FIG. 4 illustrates an internal configuration of a coin handling assembly in the money depositing and dispensing machine shown in FIG. 2, as viewed from thereabove.
Figure 5:
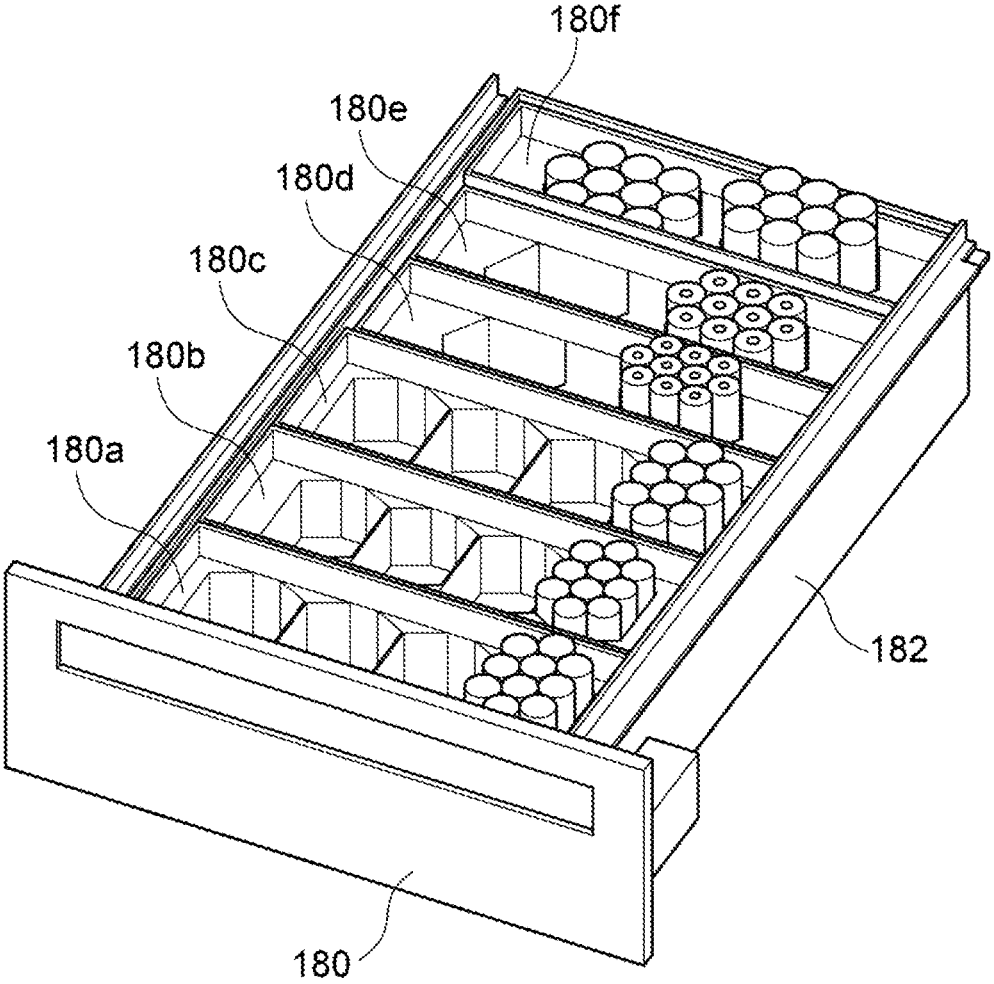
FIG. 5 is a perspective view of a configuration of a drawer unit of a coin-roll storage assembly in the money depositing and dispensing machine shown in FIG. 2.
Figure 6:
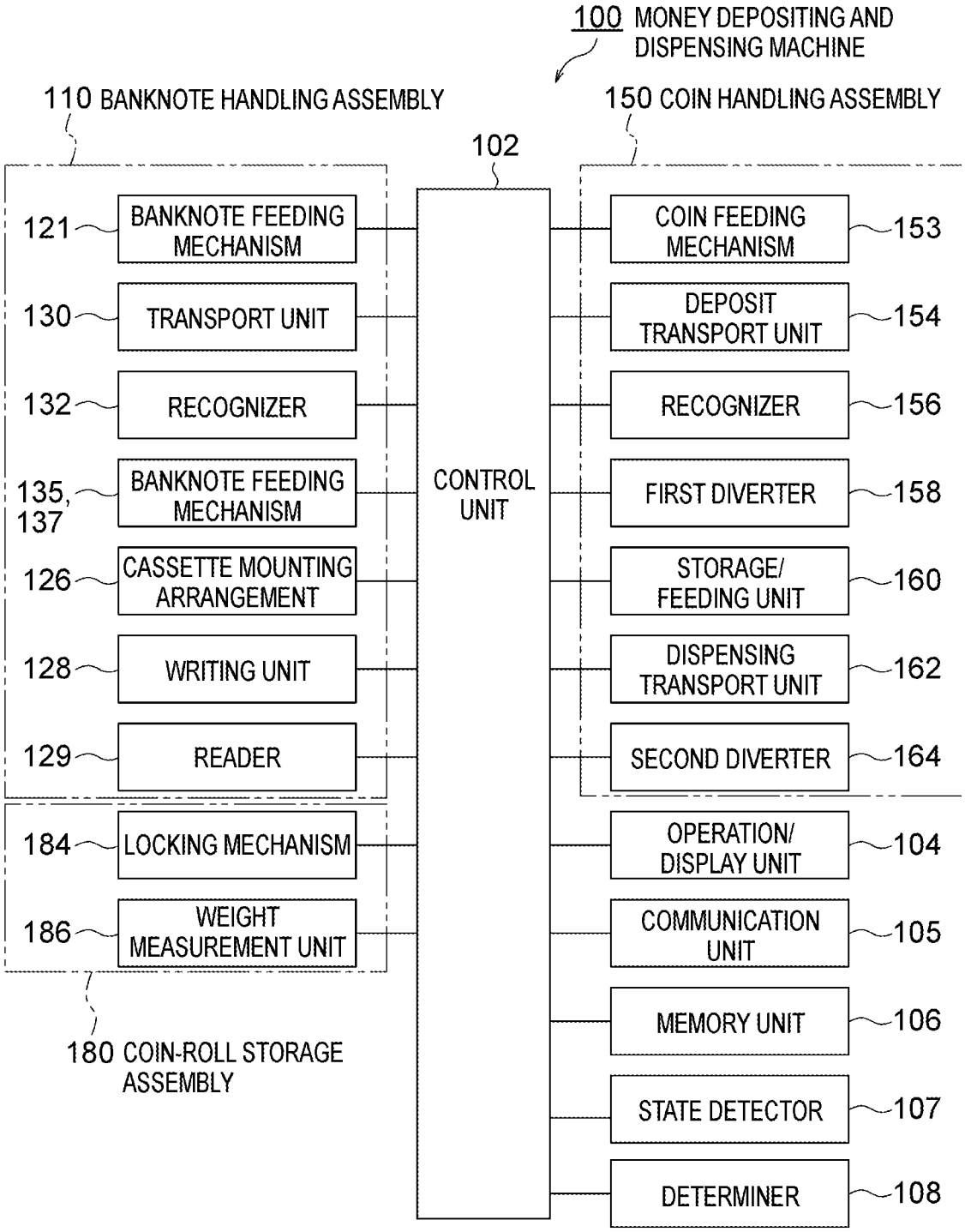
FIG. 6 is a functional block diagram illustrating a configuration of a control system in the money depositing and dispensing machine shown in FIG. 2.
Figure 7:
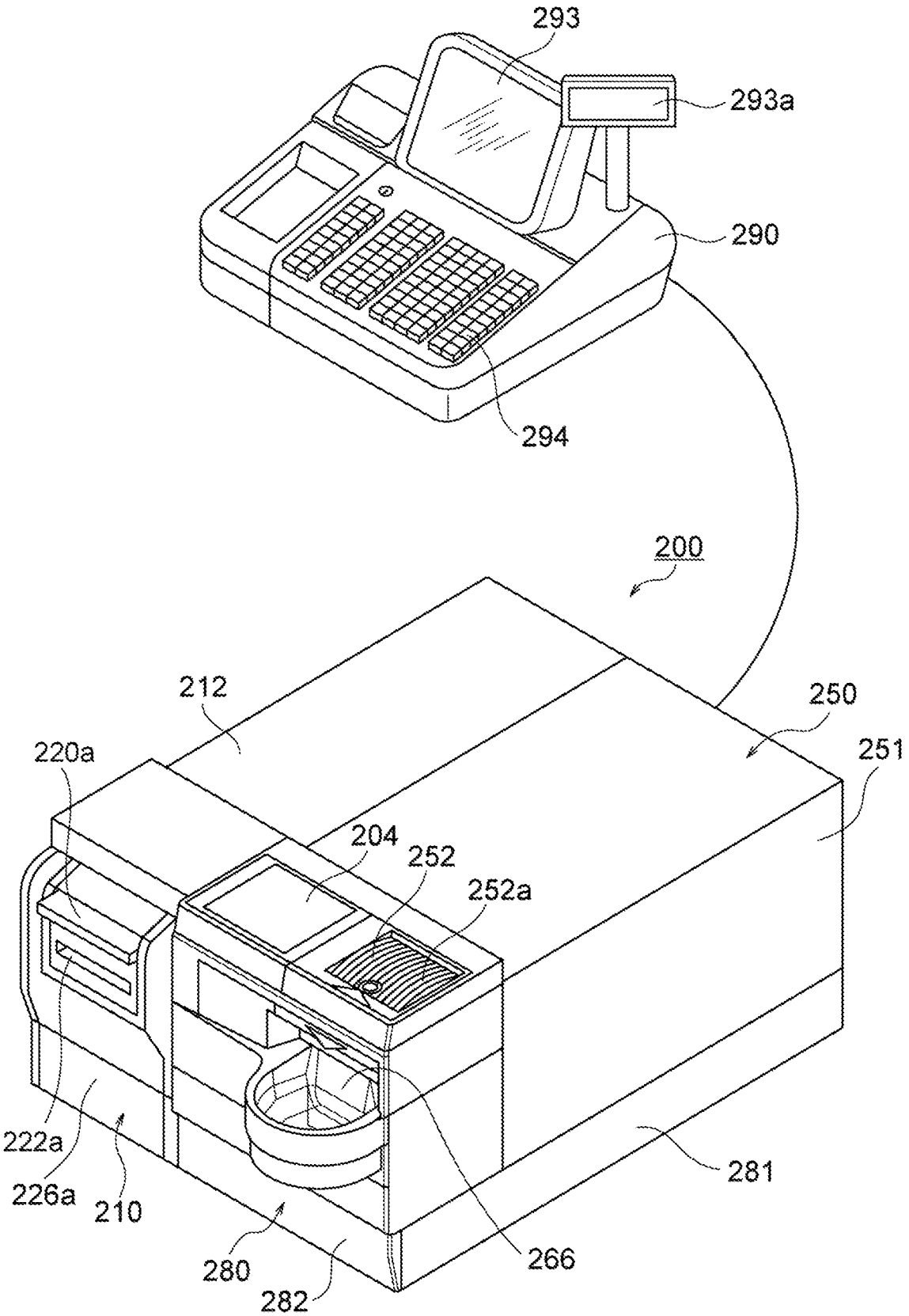
FIG. 7 is a perspective view of outer appearances of a money change machine and a POS register in the money management system shown in FIG. 1.
Figure 8:
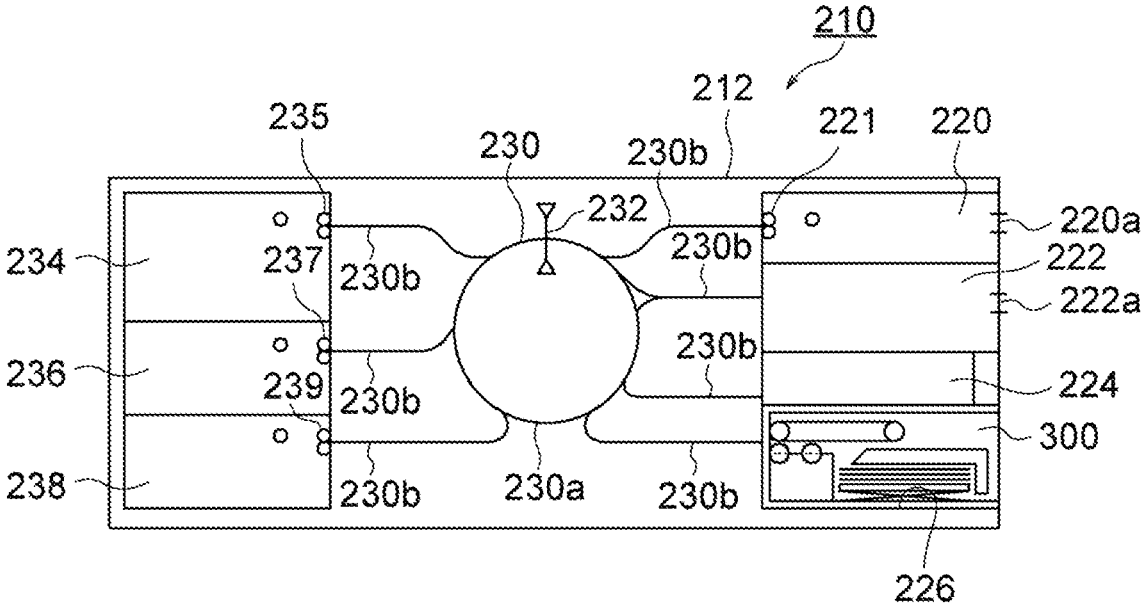
FIG. 8 illustrates an internal configuration of a banknote handling assembly in the money change machine shown in FIG. 7, as viewed from the side thereof.
Figure 9:
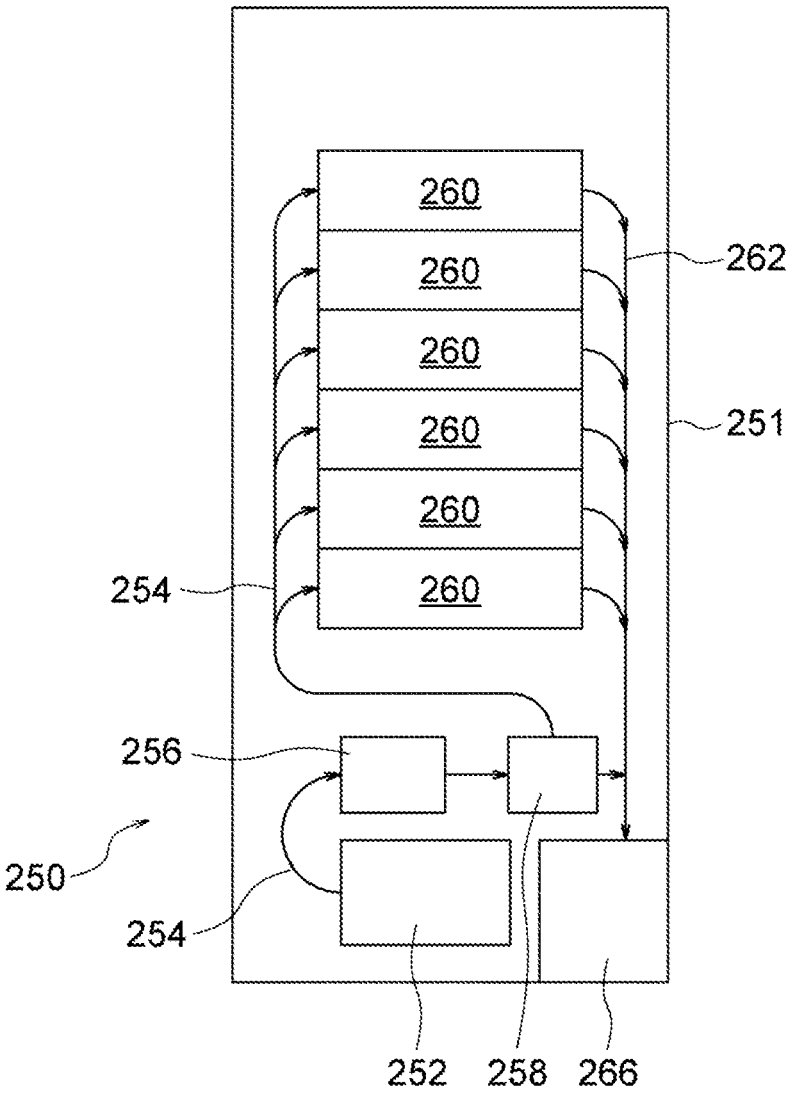
FIG. 9 illustrates an internal configuration of a coin handling assembly in the money change machine shown in FIG. 7, as viewed from thereabove.
Figure 10:
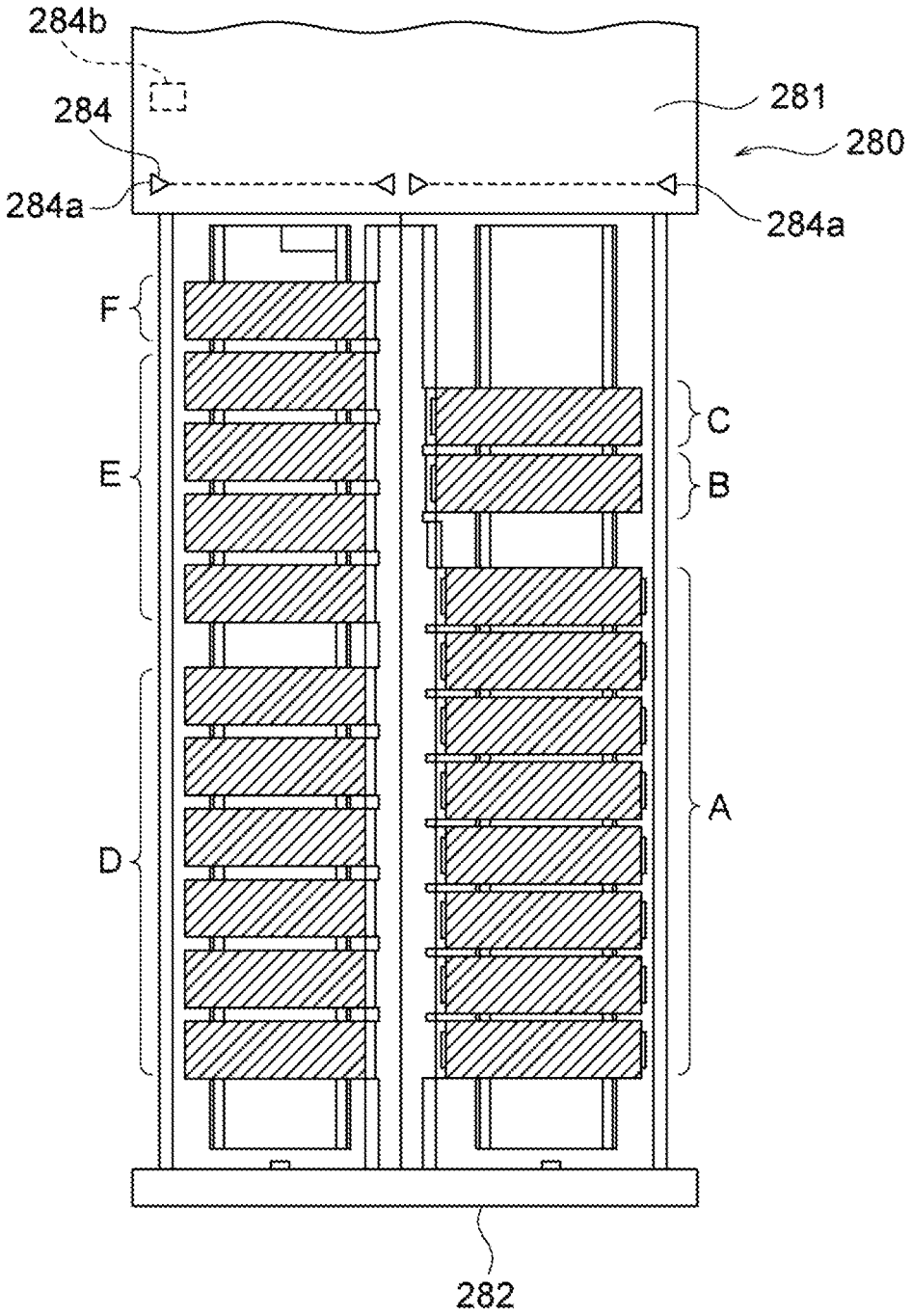
FIG. 10 illustrates a configuration of a storage drawer, of a coin-roll storage assembly, which is drawn from a housing in the money change machine shown in FIG. 7, as viewed from thereabove.
Figure 11:
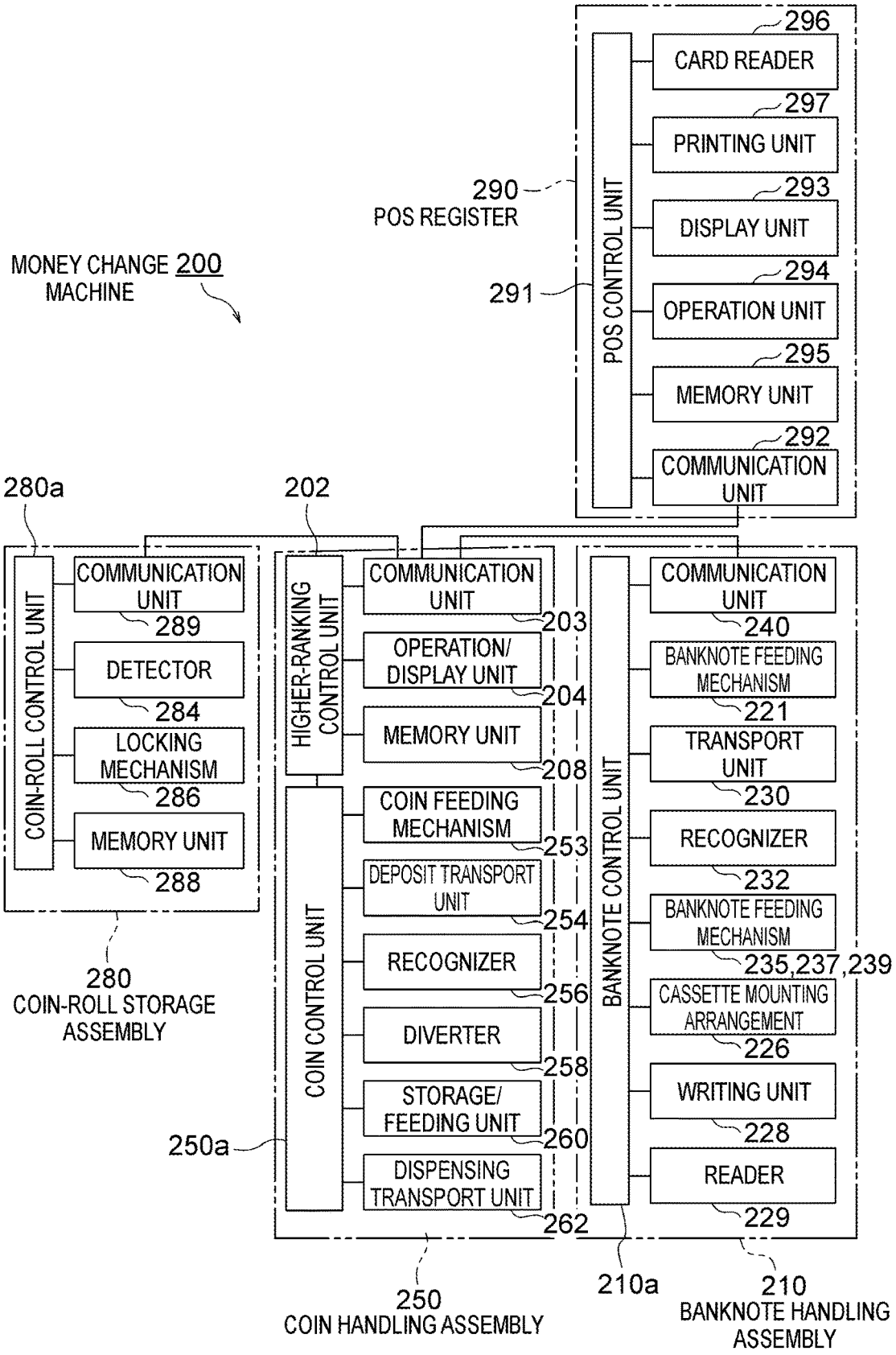
FIG. 11 is a functional block diagram illustrating a configuration of a control system in the money change machine and the POS register shown in FIG. 7.
Figure 12:
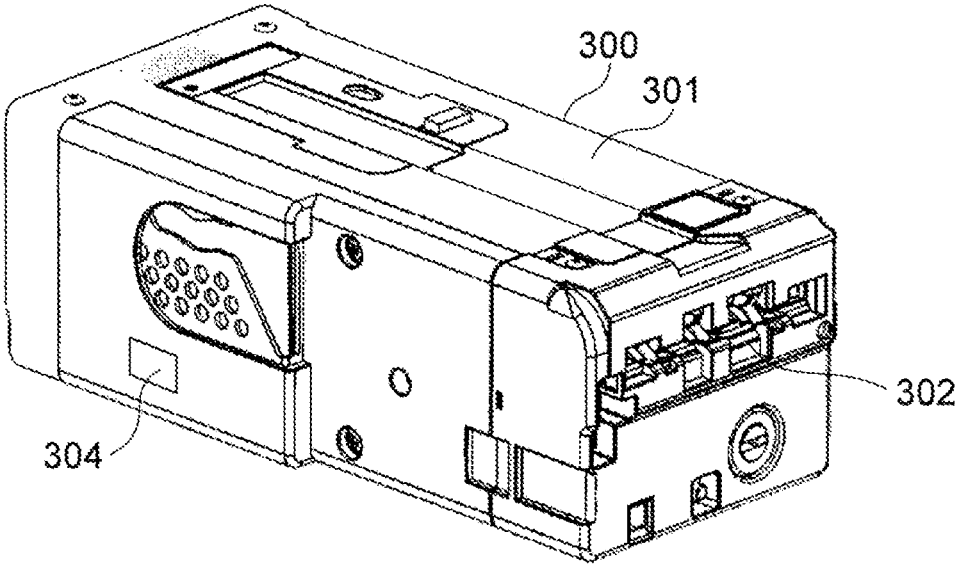
FIG. 12 is a perspective view of an outer appearance of a banknote storage cassette that is detachably mounted to a cassette mounting arrangement of the money depositing and dispensing machine and a cassette mounting arrangement of the money change machine in the money management system shown in FIG. 1.
Figure 13:
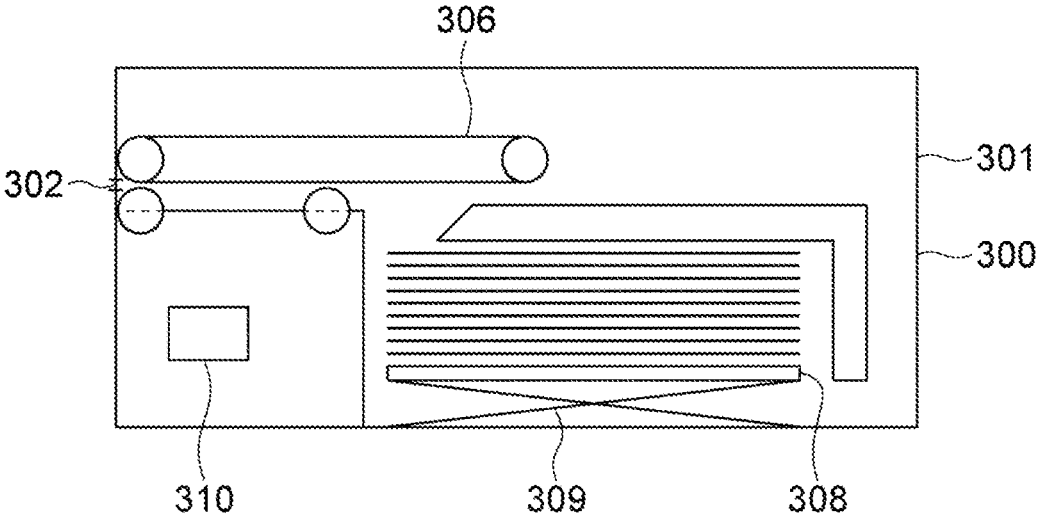
FIG. 13 illustrates an internal configuration of the banknote storage cassette shown in FIG. 12, as viewed from the side thereof.
Figure 14:
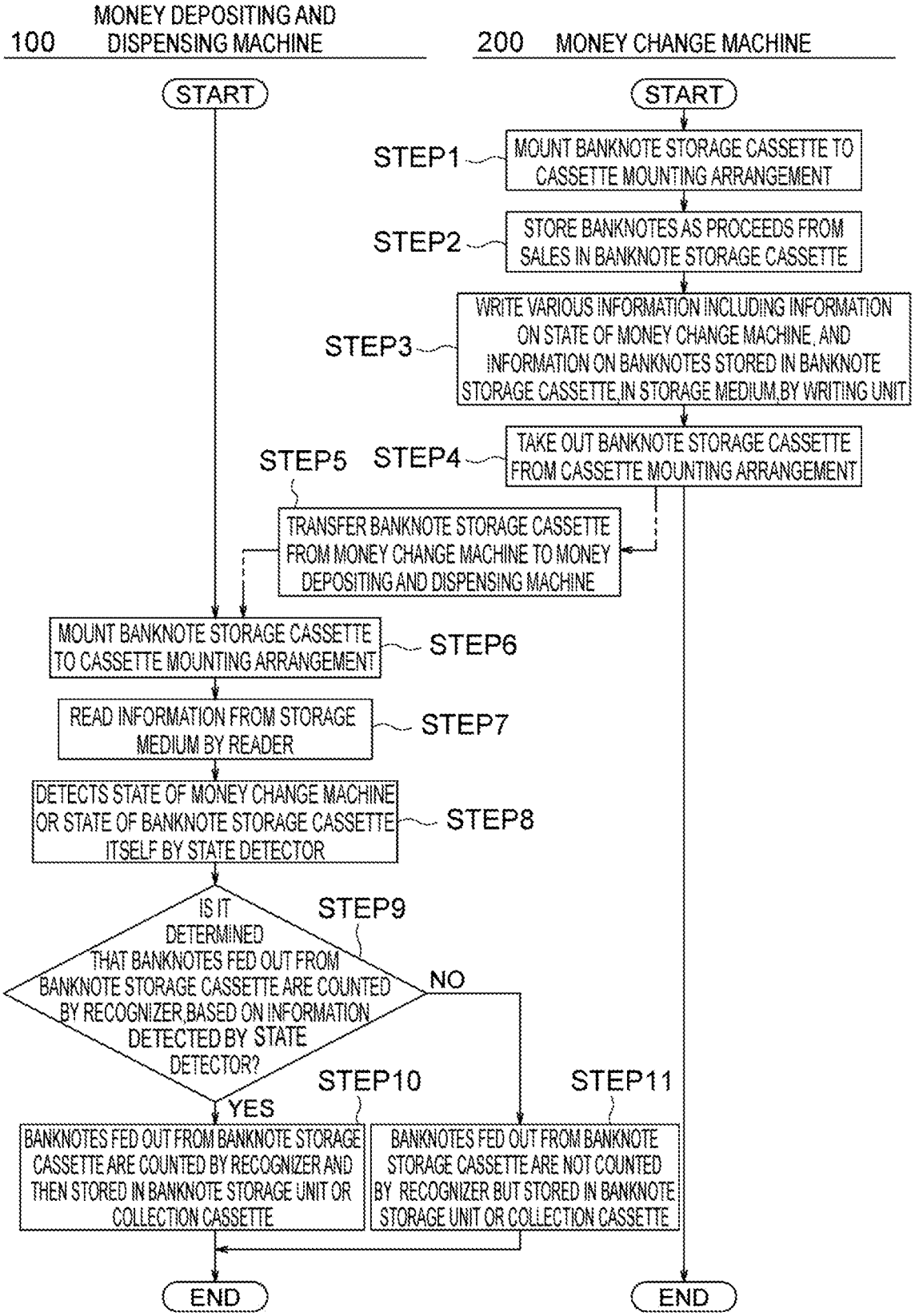
FIG. 14 is a flow chart showing operations performed by the money depositing and dispensing machine and the money change machine, respectively, when the money management system shown in FIG. 1 performs money handling.

Hereinafter, an embodiment of the present invention will be described with reference to the drawings. FIG. 1 to FIG. 14 illustrate a money management system according to the present embodiment, and a money change machine as a first money handling apparatus and a money depositing and dispensing machine as a second money handling apparatus, which are disposed in the money management system. Among them, FIG. 1 schematically illustrates a configuration of a money management system according to the present embodiment, and FIG. 2 is a perspective view of an outer appearance of a money depositing and dispensing machine in the money management system shown in FIG. 1. FIG. 3 to FIG. 5 illustrate configurations of a banknote handling assembly, a coin handling assembly, and a coin-roll storage assembly, respectively, in the money depositing and dispensing machine shown in FIG. 2. FIG. 6 is a functional block diagram illustrating a configuration of a control system in the money depositing and dispensing machine shown in FIG. 2. FIG. 7 is a perspective view of outer appearances of a money change machine and a POS register in the money management system shown in FIG. 1. FIG. 8 to FIG. 10 illustrate configurations of a banknote handling assembly, a coin handling assembly, and a coin-roll storage assembly, respectively, in the money change machine shown in FIG. 7. FIG. 11 is a functional block diagram illustrating a configuration of a control system in the money change machine and the POS register shown in FIG. 7. FIG. 12 is a perspective view of an outer appearance of a banknote storage cassette that is detachably mounted to a cassette mounting arrangement of the money depositing and dispensing machine and a cassette mounting arrangement of the money change machine in the money management system shown in FIG. 1. FIG. 13 illustrates an internal configuration of the banknote storage cassette shown in FIG. 12, as viewed from the side thereof and FIG. 14 is a flow chart showing operations performed by the money depositing and dispensing machine and the money change machine, respectively, when the money management system shown in FIG. 1 performs money handling.

As shown in FIG. 1, in a store 420 in commercial facilities such as a supermarket or a convenience store, store shelves on which various commodities are displayed are installed in a front region which customers are allowed to enter, and, in a settlement place in the front region, a money change machine 200 (a first money handling apparatus) and a POS (Point of Sales) register 290 are installed. For checkout of a customer at such a settlement place, a clerk performs depositing of money received for the commodity from the customer in the money change machine 200 or performs dispensing of money as change from the money change machine 200 and delivers the change to the customer. Furthermore, information on a commodity purchased by the customer, information on money stored in the money change machine 200, and the like are managed by the POS register 290. Furthermore, in a back office region (specifically, for example, a deposit room) which customers in the store 420 as described above are not allowed to enter, a money depositing and dispensing machine 100 (a second money handling apparatus) such as a cashier machine that performs depositing of money collected from the money change machine 200 as proceeds from sales is installed. Furthermore, in a case where money as change is insufficient in the money change machine 200, money is dispensed as change replenishment money from the money depositing and dispensing machine 100, and the money change machine 200 can be replenished with the money dispensed as the change replenishment money from the money depositing and dispensing machine 100. In the present embodiment, the money depositing and dispensing machine 100 and the money change machine 200 as described above are combined to structure a money management system 1.

Furthermore, as shown in FIG. 1, in the money management system 1 according to the present embodiment, collection cassettes 140 and 170 (described below) in which banknotes and coins are stored are taken out from the money depositing and dispensing machine 100 by, for example, a guard of a cash-in-transit company 410, and the banknotes and the coins in the collection cassettes 140 and 170 are collected from the money depositing and dispensing machine 100 by the cash-in-transit company 410 in a state where the banknotes and the coins are contained in the collection cassettes 140 and 170.

Furthermore, the guard of the cash-in-transit company 410 transports money as a change fund to be used in the money change machine 200 from the cash-in-transit company 410 to the store 420, and the money is stored in a safe 422 disposed in the store 420. In a case where money as the change fund is insufficient in the money depositing and dispensing machine 100, a manager of the store 420 takes out money from the safe 422, to deposit the money in the money depositing and dispensing machine 100.

Furthermore, as shown in FIG. 1, in the money management system 1 of the present embodiment, the money depositing and dispensing machine 100 is connected via a LAN (Local Area Network) 404 to a terminal 400 and a user server 402 disposed outside the store 420 so as to be able to communicate with the terminal 400 and the user server 402, and the terminal 400 and the user server 402 allow information on an inventory amount of money in the money depositing and dispensing machine 100, a guard or the like of the cash-in-transit company 410, and an operator such as a clerk of the store 420 to be managed.

Next, configurations of the money depositing and dispensing machine 100 and the money change machine 200 of the money management system 1 described above will be described in detail.

Firstly, the configuration of the money depositing and dispensing machine 100 disposed in the back office region in the store 420 will be described in detail with reference to FIG. 2 to FIG. 6. As shown in FIG. 2 and the like, the money depositing and dispensing machine 100 of the present embodiment has a housing 101 shaped in an almost rectangular parallelepiped. Inside the housing 101, a banknote handling assembly 110 that performs depositing and dispensing of banknotes, a coin handling assembly 150 that performs depositing and dispensing of coins, and a coin-roll storage assembly 180 that stores a coil roll (a predetermined number (for example, 20 or 50) of coins of the same denomination are collected into a roll and wrapped with a film, a wrapping paper, or the like) are accommodated. As shown in FIG. 2, the banknote handling assembly 110 and the coin handling assembly 150 are aligned in the left-right direction when the money depositing and dispensing machine 100 is viewed from the front side, and the coin-roll storage assembly 180 is disposed below the banknote handling assembly 110 and the coin handling assembly 150.

As shown in FIG. 2 and FIG. 3, the banknote handling assembly 110 includes a banknote receptacle unit 120 disposed in the right side region on the front surface side of the housing 101, a banknote dispensing unit 122 disposed below the banknote receptacle unit 120 on the front surface side of the housing 101, a transport unit 130 that transports banknotes one by one in the housing 101, and a plurality of banknote storage units 134 and 136 that stores banknotes in the housing 101 and can feed out the banknotes stored therein. In FIG. 3, the right side surface of the housing 101 corresponds to the surface on the front side of the banknote handling assembly 110, and the leftward direction in FIG. 3 corresponds to the depth direction of the banknote handling assembly 110. As shown in FIG. 3, the transport unit 130 includes a round transport unit 130*a* disposed at the center position in the upper portion of the housing 101, and a plurality of connection transport units 130*b*. Furthermore, the banknote receptacle unit 120, the banknote dispensing unit 122, a dispensing reject unit 124, a cassette mounting arrangement 126 that allows a banknote storage cassette 300 described below to be detachably mounted, the collection cassette 140, and the two banknote storage units 134 and 136 are disposed so as to surround the round transport unit 130*a*. Furthermore, as shown in FIG. 3, the plurality of connection transport units 130*b* allow connection between the round transport unit 130*a*, and each of the banknote receptacle unit 120, the banknote dispensing unit 122, the dispensing reject unit 124, the cassette mounting arrangement 126, the collection cassette 140, and the two banknote storage units 134 and 136. Furthermore, a recognizer 132 is disposed at the round transport unit 130*a*, and the recognizer 132 performs recognition of a denomination, authentication, fitness, face/back, new/old, a transport state, and the like for a banknote transported by the round transport unit 130*a*.

The round transport unit 130*a* can transport banknotes one by one in both the clockwise direction and the counterclockwise direction in FIG. 3. Furthermore, in the transport unit 130, path diverters (not shown) for changing a banknote transport path between the round transport unit 130*a* and each of the connection transport units 130*b* are disposed along the round transport unit 130*a*.

As shown in FIG. 2 and FIG. 3, a banknote inlet 120*a* of the banknote receptacle unit 120 and a banknote outlet 122*a* of the banknote dispensing unit 122 are disposed on the front surface of the housing 101. Furthermore, a door 126*a* is disposed on the front surface side of the cassette mounting arrangement 126. By the door 126*a* being opened, the banknote storage cassette 300 can be mounted to the cassette mounting arrangement 126 or the banknote storage cassette 300 can be taken out from the cassette mounting arrangement 126. Furthermore, as shown in FIG. 6, the cassette mounting arrangement 126 includes a writing unit 128 that writes various information in a storage medium 304 (described below) provided with the banknote storage cassette 300 which is mounted to the cassette mounting arrangement 126, and a reader 129 that reads various information from the storage medium 304. The information written in the storage medium 304 by the writing unit 128 and the information read from the storage medium 304 by the reader 129 will be described below in detail.

The banknote receptacle unit 120 includes a banknote feeding mechanism 121. When it is detected that one banknote or a plurality of banknotes is inserted in the banknote inlet 120*a*, the banknote feeding mechanism 121 is driven and the banknotes are thus fed out one by one through the connection transport unit 130*b* toward the round transport unit 130*a*.

The banknote dispensing unit 122 dispenses banknotes fed out from each of the banknote storage units 134, and 136 to the round transport unit 130*a*, to the outside of the housing 101, through the banknote outlet 122*a*.

In the dispensing reject unit 124, a banknote, among the banknotes fed out from each of the banknote storage units 134 and 136 during dispensing, which cannot be recognized by the recognizer 132 due to abnormality in transporting such as overlapping or skew, is stored as a rejected banknote in dispensing. Furthermore, a banknote, among banknotes taken into the housing 101 from the banknote receptacle unit 120, which cannot be recognized by the recognizer 132 in depositing due to stain or the like is returned to the banknote dispensing unit 122 as a rejected banknote in depositing.

The banknote storage units 134 and 136 store banknotes for each denomination, based on the recognition result by the recognizer 132. Banknotes to be dispensed from the money depositing and dispensing machine 100 as change replenishment money for the money change machine 200 are stored in the banknote storage units 134 and 136. Specifically, for example, 1,000-yen banknotes are stored in the banknote storage unit 134, and 5,000-yen banknotes are stored in the banknote storage unit 136. Note that 10,000-yen banknotes are stored in the collection cassette 140 described below. Furthermore, the banknote storage units 134 and 136 include banknote feeding mechanisms 135, 137, respectively, and the banknotes stored in the banknote storage units 134 and 136 are fed out one by one through the connection transport units 130*b* toward the round transport unit 130*a* by the banknote feeding mechanisms 135, 137, respectively.

In the lower region inside the housing 101, the collection cassette 140 is accommodated, and banknotes to be collected by the guard of the cash-in-transit company 410 are stored in the collection cassette 140. Specifically, a banknote recognized by the recognizer 132 is transported from the round transport unit 130*a* through the connection transport unit 130*b* to the collection cassette 140. Furthermore, a door 140*a* is disposed on the front surface side of the collection cassette 140. By the door 140*a* being opened, the collection cassette 140 can be accommodated in the housing 101 or the collection cassette 140 can be taken out from the housing 101.

Next, the configuration of the coin handling assembly 150 will be described. As shown in FIG. 2 and FIG. 4, the coin handling assembly 150 includes a coin receptacle unit 152 disposed in the left side region on the front surface side of the housing 101, a coin dispensing unit 166 disposed below the coin receptacle unit 152 on the front surface side of the housing 101, and a plurality of storage/feeding units 160 that stores coins in the housing 101 and can feed out the coins stored therein.

The coin receptacle unit 152 is designed so as to take coins received through a coin inlet, one by one, into the housing 101 in a state where the coins are arranged in one layer in one line. More specifically, the coin receptacle unit 152 includes a coin feeding mechanism 153 (see FIG. 6) implemented by a feed belt or the like. When coins received by the coin receptacle unit 152 are detected, the coin feeding mechanism 153 is driven and the coins are then fed out one by one into the housing 101 by the coin feeding mechanism 153. Furthermore, as shown in FIG. 4, a deposit transport unit 154 for transporting coins fed into the housing 101 by the coin receptacle unit 152 is connected to the coin receptacle unit 152.

As shown in FIG. 4, in the deposit transport unit 154, a recognizer 156 that performs recognition of a denomination, authentication, fitness, face/back, new/old, a transport state, and the like for a coin, and a first diverter 158 are disposed.

The first diverter 158 is designed so as to divert a coin such as a rejected coin to be dispensed through the coin dispensing unit 166, from the deposit transport unit 154, on the basis of a coin recognition result by the recognizer 156, and guide the coin to a dispensing transport unit 162.

Meanwhile, coins, such as normal coins, to be stored in the housing 101 are transported to the storage/feeding units 160 by the deposit transport unit 154. The storage/feeding units 160 are structured so as to be able to store coins for each denomination and feed out the coins stored therein. Specifically, for example, the six storage/feeding units 160 are disposed so as to correspond to six denominations (500 yen coin, 100 yen coin, 50 yen coin, 10 yen coin, 5 yen coin, and 1 yen coin) of coins that circulate in Japan. Coins are stored for each denomination in the storage/feeding units 160 from the uppermost-stream side (that is, the lowermost side in FIG. 4) of the deposit transport unit 154 in order starting from the smallest denomination coin. Furthermore, each storage/feeding unit 160 includes a coin feeding mechanism (not shown) that feeds out coins stored in the storage/feeding unit 160 one by one to the dispensing transport unit 162.

The dispensing transport unit 162 is designed so as to transport the coins fed out from the storage/feeding units 160, to the coin dispensing unit 166. Furthermore, in the dispensing transport unit 162, for example, a rejected coin diverted from the deposit transport unit 154 by the first diverter 158 is transported to the coin dispensing unit 166.

In the lower region in the housing 101, the collection cassette 170 is accommodated, and coins to be collected by the guard of the cash-in-transit company 410 are stored in the collection cassette 170. Specifically, as shown in FIG. 4, a second diverter 164 is disposed at the dispensing transport unit 162, and a coin diverted from the dispensing transport unit 162 by the second diverter 164 is transported to the collection cassette 170, and stored in the collection cassette 170. Furthermore, on the front surface side of the collection cassette 170, a door 170*a* is disposed. By the door 170*a* being opened, the collection cassette 170 can be accommodated in the housing 101 or the collection cassette 170 can be taken out from the housing 101.

Next, the configuration of the coin-roll storage assembly 180 will be described. As shown in FIG. 5, the coin-roll storage assembly 180 includes a drawer unit 182 having a plurality of storage regions 180*a* to 180*f* in which coin-rolls are stored for each denomination, and the drawer unit 182 can be drawn forward from the housing 101 of the money depositing and dispensing machine 100. As shown in FIG. 5, when coin-rolls are stored in the storage regions 180*a* to 180*f*, the long edge direction of the coin-rolls is oriented in the vertical direction. By the drawer unit 182 being drawn forward from the housing 101 of the money depositing and dispensing machine 100, coin-rolls can be stored in the storage regions 180*a* to 180*f*, or coin-rolls stored in the storage regions 180*a* to 180*f* can be taken out. Furthermore, as shown in FIG. 6, the coin-roll storage assembly 180 has a locking mechanism 184 for locking the drawer unit 182 into the housing 101. In a state where the drawer unit 182 is locked in the housing 101, the drawer unit 182 cannot be drawn forward from the housing 101. Furthermore, the coin-roll storage assembly 180 includes a weight measurement unit 186 for measuring the weight of coin-rolls stored in the respective storage regions 180*a* to 180*f* of the drawer unit 182. The number of coin-rolls stored in each of the storage regions 180*a* to 180*f* of the drawer unit 182 is detected by a control unit 102 described below, on the basis of the weight of the coin-rolls measured by the weight measurement unit 186.

Next, the configuration of a control system of the money depositing and dispensing machine 100 as described above will be described with reference to FIG. 6. As shown in FIG. 6, the control unit 102 is disposed in the housing 101 of the money depositing and dispensing machine 100 according to the present embodiment, and the control unit 102 controls components of the banknote handling assembly 110, the coin handling assembly 150, and the coin-roll storage assembly 180. Specifically, the banknote feeding mechanism 121, the transport unit 130, the recognizer 132, the banknote feeding mechanisms 135 and 137, the cassette mounting arrangement 126, the writing unit 128, the reader 129, and the like of the banknote handling assembly 110 are connected to the control unit 102. Banknote recognition information by the recognizer 132, and information read by the reader 129 from the storage medium 304 disposed at the banknote storage cassette 300 are transmitted to the control unit 102, and the control unit 102 controls the components by transmitting an instruction signal to each of the components of the banknote handling assembly 110. Furthermore, the coin feeding mechanism 153, the deposit transport unit 154, the recognizer 156, the first diverter 158, the storage/feeding units 160, the dispensing transport unit 162, the second diverter 164, and the like of the coin handling assembly 150 are connected to the control unit 102. Coin recognition information by the recognizer 156 is transmitted to the control unit 102, and the control unit 102 controls the components by transmitting an instruction signal to each of the components of the coin handling assembly 150. Furthermore, the locking mechanism 184, the weight measurement unit 186, and the like of the coin-roll storage assembly 180 are connected to the control unit 102, and the result of measurement of coin-rolls by the weight measurement unit 186 is transmitted to the control unit 102, and the control unit 102 controls the locking mechanism 184 by transmitting an instruction signal to the locking mechanism 184.

Furthermore, as shown in FIG. 6, an operation/display unit 104, a communication unit 105, a memory unit 106, a state detector 107 and a determiner 108 are connected to the control unit 102. The operation/display unit 104 is implemented by a touch panel or the like disposed at an upper portion of the housing 101. An operation screen operated by an operator, and information on an inventory amount of money stored in each of the banknote handling assembly 110, the coin handling assembly 150, and the coin-roll storage assembly 180 are displayed on the operation/display unit 104. Furthermore, the operation/display unit 104 described above allows an operator to touch an operation button on the operation screen with her/his finger, thereby inputting various instructions to the control unit 102. The communication unit 105 can transmit various signals to and receive various signals from the terminal 400 and the user server 402 via the LAN 404.

Information on an inventory amount of money stored in each of the banknote handling assembly 110, the coin handling assembly 150, and the coin-roll storage assembly 180, and various information such as a money handling history in the money depositing and dispensing machine 100 are memorized in the memory unit 106.

The state detector 107 detects a state of another apparatus (specifically, the money change machine 200) to which the banknote storage cassette 300 has already been mounted or a state of the banknote storage cassette 300 itself. The determiner 108 determines whether the recognizer 132 counts the money taken out from the banknote storage cassette 300 or not, based on the state detected by the state detector 107. Details of functions of these state detector 107 and determiner 108 will be described later.

Next, the configuration of the money change machine 200 disposed in the front region of the store 420 will be described in detail with reference to FIG. 7 to FIG. 11. As shown in FIG. 7 and the like, the money change machine 200 according to the present embodiment has a coin handling assembly 250 and a coin-roll storage assembly 280 aligned in the up-down direction, and a banknote handling assembly 210 that is aligned with and adjacent to the coin handling assembly 250 and the coin-roll storage assembly 280. The POS register 290 is placed on the banknote handling assembly 210 and the coin handling assembly 250. The banknote handling assembly 210 and the coin handling assembly 250 perform depositing and dispensing of banknotes and coins, respectively. Furthermore, the coin-roll storage assembly 280 stores coin-rolls of each denomination such that the coin-rolls can be taken out. Furthermore, the POS register 290 is used as a management device for managing the money change machine 200.

Firstly, the configuration of the banknote handling assembly 210 will be specifically described with reference to FIG. 7 and FIG. 8. As shown in FIG. 7 and FIG. 8, the banknote handling assembly 210 has a housing 212 shaped in an almost rectangular parallelepiped, a banknote receptacle unit 220 disposed on the front surface side of the housing 212, a banknote dispensing unit 222 disposed below the banknote receptacle unit 220 on the front surface side of the housing 212, a transport unit 230 that transports banknotes one by one in the housing 212, and a plurality of banknote storage units 234, 236, and 238 that stores banknotes in the housing 212 and can feed out the banknotes stored therein. In FIG. 8, the right side surface of the housing 212 corresponds to the surface on the front side of the banknote handling assembly 210, and the leftward direction in FIG. 8 corresponds to the depth direction of the banknote handling assembly 210. As shown in FIG. 8, the transport unit 230 includes a round transport unit 230*a* disposed at the center position of the housing 212, and a plurality of connection transport units 230*b*. Furthermore, the banknote receptacle unit 220, the banknote dispensing unit 222, a dispensing reject unit 224, a cassette mounting arrangement 226 that allows the banknote storage cassette 300 described below to be detachably mounted, and the three banknote storage units 234, 236, and 238 are disposed so as to surround the round transport unit 230*a*. Furthermore, as shown in FIG. 8, the plurality of connection transport units 230*b* allow connection between the round transport unit 230*a*, and each of the banknote receptacle unit 220, the banknote dispensing unit 222, the dispensing reject unit 224, the cassette mounting arrangement 226, and the three banknote storage units 234, 236, and 238. Furthermore, a recognizer 232 is disposed at the round transport unit 230*a*, and the recognizer 232 performs recognition of a denomination, authentication, fitness, face/back, new/old, a transport state, and the like for a banknote transported by the round transport unit 230*a*.

The round transport unit 230*a* can transport banknotes one by one in both the clockwise direction and the counterclockwise direction in FIG. 8. Furthermore, in the transport unit 230, path diverters (not shown) for changing a banknote transport path between the round transport unit 230*a* and each of the connection transport units 230*b* are disposed along the round transport unit 230*a*.

As shown in FIG. 7 and FIG. 8, a banknote receptacle 220*a* of the banknote receptacle unit 220 and a banknote outlet 222*a* of the banknote dispensing unit 222 are disposed on the front surface of the housing 212. Furthermore, a door 226*a* is disposed on the front surface side of the cassette mounting arrangement 226. By the door 226*a* being opened, the banknote storage cassette 300 can be mounted to the cassette mounting arrangement 226 or the banknote storage cassette 300 can be taken out from the cassette mounting arrangement 226. Furthermore, as shown in FIG. 11, the cassette mounting arrangement 226 includes a writing unit 228 that writes various information in the storage medium 304 (described below) disposed at the banknote storage cassette 300 which is mounted to the cassette mounting arrangement 226, and a reader 229 that reads various information from the storage medium 304. The information written in the storage medium 304 by the writing unit 228, and the information read from the storage medium 304 by the reader 229 will be described below in detail.

The banknote receptacle unit 220 includes a banknote feeding mechanism 221. When it is detected that one banknote or a plurality of banknotes is inserted in the banknote receptacle 220*a*, the banknote feeding mechanism 221 is driven, and the banknotes are thus fed out one by one through the connection transport unit 230*b* toward the round transport unit 230*a*.

The banknote dispensing unit 222 dispenses banknotes fed out from each of the banknote storage units 234, 236, and 238 to the round transport unit 230*a*, to the outside of the housing 212, through the banknote outlet 222*a*.

In the dispensing reject unit 224, a banknote, among the banknotes fed out from each of the banknote storage units 234, 236, and 238 during dispensing, which cannot be recognized by the recognizer 232 due to abnormality in transporting such as overlapping or skew, is stored as a rejected banknote in dispensing. Furthermore, a banknote, among banknotes taken into the housing 212 from the banknote receptacle unit 220, which cannot be recognized by the recognizer 232 in depositing due to stain or the like is returned to the banknote dispensing unit 222 as a rejected banknote in depositing.

The banknote storage units 234, 236, and 238 store banknotes for each denomination, based on the recognition result by the recognizer 232. In the banknote storage units 234, 236, and 238, banknotes deposited in the banknote handling assembly 210 as proceeds from sales, and banknotes to be dispensed as change, are stored. Specifically, for example, 1,000-yen banknotes are stored in the banknote storage unit 234, 2,000-yen banknotes and 5,000-yen banknotes are stored in the banknote storage unit 236 in a mixed state, and 10,000-yen banknotes are stored in the banknote storage unit 238. Furthermore, the banknote storage units 234, 236, and 238 include banknote feeding mechanisms 235, 237, and 239, respectively, and banknotes stored in the banknote storage units 234, 236, and 238 are fed out one by one through the connection transport units 230*b* toward the round transport unit 230*a* by the banknote feeding mechanisms 235, 237, and 239, respectively.

Next, the configuration of the coin handling assembly 250 will be described. As shown in FIG. 7 and FIG. 9, the coin handling assembly 250 includes a housing 251 shaped in an almost rectangular parallelepiped, a coin receptacle unit 252 disposed on the front surface side of the housing 251, a coin dispensing unit 266 disposed below the coin receptacle unit 252 on the front surface side of the housing 251, and a plurality of storage/feeding units 260 that stores coins in the housing 251 and can feed out the coins stored therein.

The coin receptacle unit 252 is designed so as to take coins received through a coin inlet, one by one, into the housing 251 in a state where the coins are arranged in one layer in one line. More specifically, the coin receptacle unit 252 includes a coin feeding mechanism 253 (see FIG. 11) implemented by a feed belt or the like. When coins received by the coin receptacle unit 252 are detected, the coin feeding mechanism 253 is driven and the coins are then fed out one by one into the housing 251 by the coin feeding mechanism 253. Furthermore, as shown in FIG. 9, a deposit transport unit 254 for transporting coins fed into the housing 251 by the coin receptacle unit 252 is connected to the coin receptacle unit 252.

As shown in FIG. 9, in the deposit transport unit 254, a recognizer 256 that performs recognition of a denomination, authentication, fitness, face/back, new/old, a transport state, and the like for a coin, and a diverter 258 are disposed. The diverter 258 is designed so as to divert a coin such as a rejected coin to be dispensed through the coin dispensing unit 266, from the deposit transport unit 254, on the basis of a coin recognition result by the recognizer 256, and guide the coin to a dispensing transport unit 262.

Meanwhile, coins, such as normal coins, to be stored in the housing 251 are transported to the storage/feeding units 260 by the deposit transport unit 254. The storage/feeding units 260 are structured so as to be able to store coins for each denomination and feed out the coins stored therein. Specifically, for example, the six storage/feeding units 260 are disposed so as to correspond to six denominations (500-yen coin, 100-yen coin, 50-yen coin, 10-yen coin, 5-yen coin, and 1-yen coin) of coins that circulate in Japan. Coins are stored for each denomination in the storage/feeding units 260 from the uppermost-stream side (that is, the lowermost side in FIG. 9) of the deposit transport unit 254 in order starting from the smallest denomination coin. Furthermore, each storage/feeding unit 260 includes a coin feeding mechanism (not shown) that feeds out coins stored in the storage/feeding unit 260 one by one to the dispensing transport unit 262.

The dispensing transport unit 262 is designed so as to transport the coins fed out from the storage/feeding units 260, to the coin dispensing unit 266. Furthermore, in the dispensing transport unit 262, for example, a rejected coin diverted from the deposit transport unit 254 by the diverter 258 is transported to the coin dispensing unit 266.

Next, the configuration of the coin-roll storage assembly 280 will be specifically described. As shown in FIG. 7 and FIG. 10, the coin-roll storage assembly 280 includes a housing 281 that is shaped in an almost rectangular parallelepiped and is opened on the side surface on the front surface side, and a storage drawer 282 that can be accommodated in the housing 281 and can be drawn forward from the housing 281. In the storage drawer 282, coin-rolls of each denomination are stored in, for example, two rows (in FIG. 10, coin-rolls, of each denomination, stored in the storage drawer 282 are represented by diagonal lines). The storage drawer 282 has a plurality of storage portions (pockets) each of which stores one coin-roll, and the number and positions of coin-rolls, for each denomination, to be stored in the storage portions are preset. Specifically, in FIG. 10, eight 100-yen coin-rolls can be stored in a region indicated by reference character A, one 500-yen coin-roll can be stored in a region indicated by reference character B, and one 50-yen coin-roll can be stored in a region indicated by reference character C. Furthermore, in FIG. 10, six 10-yen coin-rolls can be stored in a region indicated by reference character D, four 1-yen coin-rolls can be stored in a region indicated by the reference character E, and one 5-yen coin-roll can be stored in a region indicated by the reference character F.

Furthermore, as shown in FIG. 11, a locking mechanism 286 for locking the storage drawer 282 into the housing 281 when the storage drawer 282 has been completely accommodated in the housing 281 is disposed in the housing 281 of the coin-roll storage assembly 280. When the storage drawer 282 has been locked in the housing 281 by the locking mechanism 286, the storage drawer 282 cannot be drawn forward from the housing 281. Therefore, the coin-rolls cannot be taken out from the storage drawer 282.

Furthermore, near an opening in the front surface of the housing 281 of the coin-roll storage assembly 280, a detector 284 is disposed which detects, for each denomination, the number of coin-rolls stored in the storage drawer 282 when the storage drawer 282 is drawn forward from the housing 281 and returned into the housing 281. Specifically, as shown in FIG. 10 and the like, the detector 284 has a pair of left and right optical sensors 284*a*, and a rotary encoder 284*b* that detects a distance over which the storage drawer 282 is drawn from the housing 281. Each of the optical sensors 284*a* has a light emitting element and a light receiving element, and light emitted from the light emitting element is transmitted to the light receiving element through an optical axis that extends in the width direction (in the left-right direction in FIG. 10) of the coin-roll storage assembly 280. When the storage drawer 282 has been completely accommodated in the housing 281, or when the storage drawer 282 has been completely drawn from the housing 281, light emitted from the light emitting element is received by the light receiving element in each of the optical sensors 284*a*. Meanwhile, when the storage drawer 282 is being drawn forward from the housing 281, or when the storage drawer 282 is being returned into the housing 281, light emitted from the light emitting element is blocked by the coin-rolls stored in the storage drawer 282 and does not reach the light receiving element, whereby presence or absence of a hole in the coin-rolls and the size of the diameter of the coin-rolls can be detected. As described above, in the storage drawer 282, the number and positions of the coin-rolls, for each denomination, to be stored are preset. Therefore, for example, the number of coin-rolls, for each denomination, stored in the storage drawer 282, and whether each coin-roll is correctly stored at a predetermined position in the storage drawer 282 are detected based on presence or absence of a hole in the coin-rolls and the size of the diameter of the coin-rolls, which are detected by the optical sensor 284*a*, and a distance, detected by the rotary encoder 284*b*, over which the storage drawer 282 has been drawn from the housing 281.

The coin-roll storage assembly 280 according to the present embodiment is not limited to the above-described configuration. In the coin-roll storage assembly 280 having another configuration, a sensor for detecting presence or absence and a denomination (material) of coin-rolls stored in a storage portion of the storage drawer 282 may be disposed in each of the storage portions, as the detector 284 that detects the number of coin-rolls, for each denomination, stored in the storage drawer 282.

Next, the configuration of the POS register 290 will be specifically described. As shown in FIG. 7 and FIG. 11, the POS register 290 includes a POS control unit 291, and a display unit 293 such as a monitor and an operation unit 294 such as an operation key. The display unit 293 and the operation unit 294 are connected to the POS control unit 291. An operator is allowed to operate the operation unit 294, thereby providing the POS control unit 291 with various instructions. Furthermore, the display unit 293 displays information representing, for example, handling states of handling banknotes and coins in the banknote handling assembly 210 and the coin handling assembly 250, and inventory amount of banknotes and coins stored in the banknote handling assembly 210 and the coin handling assembly 250. Furthermore, the POS register 290 has an additional display unit 293*a* which can be viewed by a customer, and various information may be displayed on the additional display unit 293*a* instead of various information being displayed on the display unit 293 or in addition to various information being displayed on the display unit 293. Furthermore, the POS register 290 has a card reader 296 and a printing unit 297 (see FIG. 11, not shown in FIG. 7). The card reader 296 reads an ID card carried by an operator such as a clerk, and then obtains information on the ID, the authority, or the like of the operator. Furthermore, the printing unit 297 is implemented by, for example, a printer, and prints, on a receipt, information such as the inventory amount of banknotes and coins stored in the banknote handling assembly 210 and the coin handling assembly 250, in addition to a sales receipt and summing receipt.

Next, the configuration of a control system of the money change machine 200 as described above will be described with reference to FIG. 11. As shown in FIG. 11, the coin handling assembly 250 has a higher-ranking control unit 202 and a coin control unit 250*a*. The higher-ranking control unit 202 and the coin control unit 250*a* are connected to each other. Furthermore, the banknote handling assembly 210 has a banknote control unit 210*a*, and the banknote control unit 210*a* is connected to the higher-ranking control unit 202 of the coin handling assembly 250. Furthermore, the coin-roll storage assembly 280 has a coin-roll control unit 280*a*, and the coin-roll control unit 280*a* is connected to the higher-ranking control unit 202 of the coin handling assembly 250. Furthermore, the POS control unit 291 disposed in the POS register 290 is also connected to the higher-ranking control unit 202 of the coin handling assembly 250. Furthermore, the POS control unit 291 of the POS register 290 is connected to a higher-ranking terminal such as a store server so as to be able to communicate with the higher-ranking terminal, which is not shown.

As shown in FIG. 11, a communication unit 203 for communication with each of the banknote handling assembly 210, the coin-roll storage assembly 280, and the POS register 290, an operation/display unit 204, and a memory unit 208 are connected to the higher-ranking control unit 202 of the coin handling assembly 250. The higher-ranking control unit 202 transmits signals to and receives signals from the banknote control unit 210*a* of the banknote handling assembly 210, the coin-roll control unit 280*a* of the coin-roll storage assembly 280, and the POS control unit 291 of the POS register 290 through the communication unit 203. Furthermore, the operation/display unit 204 is implemented by, for example, a touch panel disposed on the upper surface of the housing 251 of the coin handling assembly 250, and an operation screen operated by an operator, and information on an inventory amount of money stored in each of the banknote handling assembly 210, the coin handling assembly 250, and the coin-roll storage assembly 280 are displayed on the operation/display unit 204. The operation/display unit 204 described above allows an operator to touch an operation button on the operation screen with his/her finger, and thus input various instructions to the higher-ranking control unit 202. In the memory unit 208, various information such as information on an inventory amount of money stored in each of the banknote handling assembly 210, the coin handling assembly 250, and the coin-roll storage assembly 280, and a money handling history in the money change machine 200, is memorized.

Furthermore, a communication unit 240, the banknote feeding mechanism 221, the transport unit 230, the recognizer 232, the banknote feeding mechanisms 235, 237, and 239, the cassette mounting arrangement 226, the writing unit 228, the reader 229, and the like are connected to the banknote control unit 210*a* of the banknote handling assembly 210. Banknote recognition information by the recognizer 232, and information read by the reader 229 from the storage medium 304 disposed at the banknote storage cassette 300 are transmitted to the banknote control unit 210*a*, and the banknote control unit 210*a* transmits instruction signals to the components of the banknote handling assembly 210, thereby controlling the components. Furthermore, the banknote control unit 210*a* uses the communication unit 240 to transmit a signal to and receive a signal from the higher-ranking control unit 202 of the coin handling assembly 250.

Furthermore, the coin feeding mechanism 253, the deposit transport unit 254, the recognizer 256, the diverter 258, each storage/feeding unit 260, the dispensing transport unit 262, and the like are connected to the coin control unit 250*a* of the coin handling assembly 250. Coin recognition information by the recognizer 256 is transmitted to the coin control unit 250*a*, and the coin control unit 250*a* transmits instruction signals to the components of the coin handling assembly 250, thereby controlling the components thereof.

Furthermore, a communication unit 289, the detector 284, the locking mechanism 286, a memory unit 288, and the like are connected to the coin-roll control unit 280*a* of the coin-roll storage assembly 280. Detection information for coin-rolls by the detector 284 is transmitted to the coin-roll control unit 280*a*, and the coin-roll control unit 280*a* transmits an instruction signal to the locking mechanism 286, thereby controlling the locking mechanism 286. Furthermore, the coin-roll control unit 280*a* uses the communication unit 289 to transmit a signal to and receive a signal from the higher-ranking control unit 202 of the coin handling assembly 250. Furthermore, for example, information on an inventory amount of coin-rolls stored in the storage drawer 282 of the coin-roll storage assembly 280 is stored in the memory unit 288.

Furthermore, the card reader 296, the printing unit 297, the display unit 293, the operation unit 294, a memory unit 295, a communication unit 292, and the like are connected to the POS control unit 291 of the POS register 290 so as to be able to communicate with the POS control unit 291. An instruction inputted to the operation unit 294 by an operator is transmitted from the operation unit 294 to the POS control unit 291, and information, on an ID card of an operator such as a clerk, which is read by the card reader 296 is transmitted to the POS control unit 291. Furthermore, the POS control unit 291 causes the display unit 293 to display various information by transmitting an instruction to the display unit 293. The POS control unit 291 may cause the additional display unit 293*a* to display various information instead of causing the display unit 293 to display various information or in addition to causing the display unit 293 to display various information. Furthermore, the POS control unit 291 causes the printing unit 297 to print various information on a receipt or the like by transmitting an instruction to the printing unit 297. Furthermore, the POS control unit 291 of the POS register 290 uses the communication unit 292 to transmit a signal to and receive a signal from a higher-ranking terminal (not shown) such as a store server, and the higher-ranking control unit 202 of the coin handling assembly 250. Furthermore, various information such as coin and banknote handling states, in the banknote handling assembly 210 and the coin handling assembly 250, which are transmitted from, for example, the banknote handling assembly 210 and the coin handling assembly 250, and inventory amount of banknotes, coins, and coin-rolls stored in the banknote handling assembly 210, the coin handling assembly 250, and the coin-roll storage assembly 280, is memorized in the memory unit 295.

Next, the configuration of the banknote storage cassette 300 for exchanging banknotes between the money depositing and dispensing machine 100 and the money change machine 200 will be described with reference to FIGS. 12 and 13. As shown in FIGS. 12 and 13, the banknote storage cassette 300 has a casing 301 shaped in an almost rectangular parallelepiped, and banknotes are stored in the casing 301 in a stacked state. Furthermore, as described above, the banknote storage cassette 300 is capable to be detachably mounted to the cassette mounting arrangement 126 of the money depositing and dispensing machine 100 and the cassette mounting arrangement 226 of the money change machine 200. Furthermore, an opening 302 is formed in the side surface of the casing 301 of the banknote storage cassette 300. When the banknote storage cassette 300 is mounted to the cassette mounting arrangement 126 of the money depositing and dispensing machine 100 or the cassette mounting arrangement 226 of the money change machine 200, banknotes are transported through the opening 302 into the banknote storage cassette 300 by the transport unit 130 disposed at the banknote handling assembly 110 of the money depositing and dispensing machine 100 or the transport unit 230 disposed at the banknote handling assembly 210 of the money change machine 200, and banknotes stored in the banknote storage cassette 300 are fed out through the opening 302 to the transport unit 130 of the banknote handling assembly 110 of the money depositing and dispensing machine 100 or the transport unit 230 of the banknote handling assembly 210 of the money change machine 200.

More specifically, a door (not shown) is disposed at the banknote storage cassette 300, and when this door is opened, an operator can access into the casing 301. The door is locked by a locking mechanism (not shown) and only the operator having predetermined authority (for example, a manager of the store 420 or the like) can unlock the door locked by the locking mechanism and open this door. In addition, as shown in FIG. 13, a banknote feeding mechanism 306, such as a circulation belt, for feeding out banknotes stored in the banknote storage cassette 300 through the opening 302 to the outside of the casing 301 is provided in the banknote storage cassette 300. Furthermore, when the banknote storage cassette 300 is mounted to the cassette mounting arrangement 126 of the money depositing and dispensing machine 100 or the cassette mounting arrangement 226 of the money change machine 200, power is transmitted to the banknote feeding mechanism 306 of the banknote storage cassette 300 from the banknote handling assembly 110 of the money depositing and dispensing machine 100 or the banknote handling assembly 210 of the money change machine 200. Thus, in a state where the banknote storage cassette 300 is taken out from the cassette mounting arrangement 126 of the money depositing and dispensing machine 100 or the cassette mounting arrangement 226 of the money change machine 200, the banknotes stored in the banknote storage cassette 300 cannot be fed out to the outside of the casing 301. Therefore, security for banknotes stored in the banknote storage cassette 300 can be enhanced.

A stage 308 on which banknotes are placed in a stacked state and a pantograph 309 for raising or lowering the stage 308 are provided in the banknote storage cassette 300. When the banknotes are stored in the banknote storage cassette 300, the stage 308 is gradually lowered by the pantograph 309, whereby a storage space for the banknotes is formed inside the banknote storage cassette 300. On the other hand, when feeding out the banknotes from the banknote storage cassette 300, the stage 308 is gradually raised by the pantograph 309. Thus, among the plurality of banknotes placed on the stage 308 in a stacked state, the uppermost banknote always contacts the banknote feeding mechanism 306.

As shown in FIG. 12, the storage medium 304 such as an IC chip is disposed on the side surface of the casing 301 of the banknote storage cassette 300. When the banknote storage cassette 300 is mounted to the cassette mounting arrangement 126 of the money depositing and dispensing machine 100 or the cassette mounting arrangement 226 of the money change machine 200, various information can be written and recorded in the storage medium 304 by the writing unit 128 disposed at the cassette mounting arrangement 126 of the money depositing and dispensing machine 100 or the writing unit 228 disposed at the cassette mounting arrangement 226 of the money change machine 200, or various information recorded in the storage medium 304 can be read from the storage medium 304 by the reader 129 disposed at the cassette mounting arrangement 126 of the money depositing and dispensing machine 100 or the reader 229 disposed at the cassette mounting arrangement 226 of the money change machine 200. As various information written in the storage medium 304 by the writing unit 228 or read from the storage medium 304 by the reader 229, information on the number of banknotes for each denomination stored in the banknote storage cassette 300, the monetary amount of banknotes for each denomination stored in the banknote storage cassette 300, or identification information of the money change machine 200 (concretely, a register number) is applied. Furthermore, as various information written in the storage medium 304 by the writing unit 228 or read from the storage medium 304 by the reader 229, inventory information on money stored in money change machine 200 (specifically, the number of banknotes, coins and coin-rolls for each denomination stored in the money change machine 200, or the monetary amount of banknotes, coins and coin-rolls for each denomination stored in the money change machine 200), or the number of money or the monetary amount of money for each denomination, which are dispensed for collection from the money change machine 200 and are not stored in the banknote storage cassette 300 (specifically, coins, coin-rolls, and banknotes paid out from the housing 212 through the banknote outlet 222*a* and the like of banknote handling assembly 210), is applied. In addition, in the present embodiment, information on a state of the money change machine 200 (specifically, information such as whether abnormality such as jamming phenomenon of the banknote (in other words, an error) has occurred in the banknote handling assembly 210 of the money change machine 200) is recorded.

In the banknote storage cassette 300, a component-operation detector 310 is provided for detecting that the components of the banknote storage cassette 300 (specifically, the door (not shown) of the banknote storage cassette 300, the banknote feeding mechanism 306, the pantograph 309 and the like) are operated. Information detected by the component-operation detector 310 is recorded in the storage medium 304.

Next, an operation performed by the money management system 1 having such a configuration will be described. In the money management system 1 according to the present embodiment, when dispensing (collecting) money as proceeds from sales in the store 420 from the money change machine 200 and storing them in the money depositing and dispensing machine 100 after the opening hours of the store 420, the banknotes stored in the banknote handling assembly 210 of the money change machine 200 are stored in the banknote storage cassette 300. Then, the banknote storage cassette 300 storing the banknotes is transferred from the money change machine 200 to the money depositing and dispensing machine 100, and the banknote storage cassette 300 transferred to the money depositing and dispensing machine 100 is mounted to the cassette mounting arrangement 126 of the banknote handling assembly 110. In this way, the banknotes stored in the banknote storage cassette 300 are stored in the banknote handling assembly 110. On the other hand, regarding coins stored in the coin handling assembly 250 of the money change machine 200, the coins are dispensed from the coin handling assembly 250 and the operator stores the dispensed coins, for example, in a storage case and the like by hand. After transferring the storage case storing the coins from the money change machine 200 to the money depositing and dispensing machine 100, the coins are taken out from this storage case and deposited in the coin handling assembly 150 of the money depositing and dispensing machine 100. In the present embodiment, one banknote storage cassette 300 may be shared for a plurality of money change machines 200.

When dispensing money as the change replenishment money from the money depositing and dispensing machine 100 and storing them in the money change machine 200, the banknotes stored in the banknote handling assembly 110 of the money depositing and dispensing machine 100 are stored in the banknote storage cassette 300. Then, the banknote storage cassette 300 storing the banknotes is transferred from the money depositing and dispensing machine 100 to the money change machine 200, and the banknote storage cassette 300 transferred to the money change machine 200 is mounted to the cassette mounting arrangement 226 of the banknote handling assembly 210. In this way, the banknotes stored in the banknote storage cassette 300 are stored inside the housing 212 of the banknote handling assembly 210. On the other hand, regarding coins or coin-rolls stored in the coin handling assembly 150 or coin-roll storage assembly 180 of the money depositing and dispensing machine 100, the coins or coin-rolls are dispensed from the coin handling assembly 150 or coin-roll storage assembly 180 and the operator stores the dispensed coins or coin-rolls, for example, in the storage case and the like by hand. After transferring the storage case storing the coins or coin-rolls from the money depositing and dispensing machine 100 to the money change machine 200, the coins or coin-rolls are taken out from this storage case and deposited in the coin handling assembly 250 or coin-roll storage assembly 280 of the money change machine 200.

Details of the operation of dispensing (collecting) money, as proceeds from sales in the store 420 from the money change machine 200 and storing the money in the money depositing and dispensing machine 100 after the opening hours of the store 420 will be described with reference to the flowchart shown in FIG. 14. When the banknotes in the money as proceeds from sales are collected from the banknote handling assembly 210 of the money change machine 200, and stored in the banknote handling assembly 110 of the money depositing and dispensing machine 100, an operator such as a clerk firstly mounts the empty banknote storage cassette 300 to the cassette mounting arrangement 226 disposed in the banknote handling assembly 210 of the money change machine 200 (STEP1). The banknotes are stored in the banknote storage cassette 300 as proceeds from sales of the store 420 (STEP2). Specifically, among banknotes stored in the banknote storage units 234, 236, and 238, banknotes which are other than banknotes to be left as change in the banknote storage units 234, 236, and 238 (that is, which are other than banknotes to be left as a change fund), are fed out to the transport unit 230 from the banknote storage units 234, 236, and 238 by the banknote feeding mechanisms 235, 237, and 239, respectively, and transported to the banknote storage cassette 300 mounted to the cassette mounting arrangement 226 by the transport unit 230. Furthermore, when the banknotes are stored in the banknote storage cassette 300 as proceeds from sales of the store 420, the writing unit 228 writes, in the storage medium 304, various information including information on a state of the money change machine 200, and information on the banknotes stored in the banknote storage cassette 300 (STEP3). More specifically, the writing unit 228 writes the above described information stored in the memory unit 208 to the storage medium 304, when the banknote storage cassette 300 is removed from the cassette mounting arrangement 226 in the banknote handling assembly 210 of the money change machine 200. At this time, if abnormality such as jamming phenomenon of the banknote occurs in the banknote handling assembly 210 of the money change machine 200, the writing unit 228 writes information indicating that abnormality has occurred in the banknote handling assembly 210 in the storage medium 304. In addition, information on the money to be dispensed that includes the number of the money other than the banknotes stored in the banknote storage cassette 300 for each denomination or monetary amount of the money for each denomination, of money collected from the money change machine 200 (for example, coins collected from the coin handling assembly 250 or coin-rolls collected from the coin-roll storage assembly 280, an overflow banknote that was not delivered to the banknote storage cassette 300 and was paid out of the housing 212 through the banknote outlet 222*a*, dispense rejected banknote and the like), may also be written in storage medium 304 by writing unit 228. Furthermore, identification information (specifically, the store number and the register number, or only the register number) of the money change machine 200 recorded in the memory unit 208 may also be written in the storage medium 304 by the writing unit 228.

Then, when banknotes have been stored in the banknote storage cassette 300 as proceeds from sales of the store 420, the operator takes out the banknote storage cassette 300 from the cassette mounting arrangement 226 (STEP4). Thereafter, the operator carries the banknote storage cassette 300 to the money depositing and dispensing machine 100 disposed in the back office region from the money change machine 200 disposed in the front region (STEP5), and mounts the banknote storage cassette 300 to the cassette mounting arrangement 126 in the banknote handling assembly 110 of the money depositing and dispensing machine 100 (STEP6).

When the banknote storage cassette 300 has been mounted to the cassette mounting arrangement 126 in the banknote handling assembly 110 of the money depositing and dispensing machine 100, the information recorded in the storage medium 304 disposed at the banknote storage cassette 300 is read by the reader 129 disposed at the cassette mounting arrangement 126 (STEP7). Specifically, various information including information on the state of the money change machine 200, and information on the banknotes stored in the banknote storage cassette 300 is read by the reader 129, and the information read by the reader 129 is transmitted to the control unit 102 of the money depositing and dispensing machine 100. The state detector 107 detects the state of another apparatus (specifically, the money change machine 200) to which the banknote storage cassette 300 has already been mounted or the state of the banknote storage cassette 300 itself based on the information read from the storage medium 304 by the reader 129 (STEP8).

When the banknote storage cassette 300 is mounted to the cassette mounting arrangement 126 in the banknote handling assembly 110 of the money depositing and dispensing machine 100, the banknotes are fed out from the banknote storage cassette 300 to the transport unit 130 of the banknote handling assembly 110, and the fed banknotes are transported to the banknote storage units 134 and 136, and the collection cassette 140 by the transport unit 130, and stored in the banknote storage units 134 and 136, and the collection cassette 140. In this way, the banknotes in the money as the proceeds from sales in the store 420 collected from the money change machine 200 are stored in the money depositing and dispensing machine 100. Furthermore, in the present embodiment, based on the state detected by the state detector 107, it is determined by the determiner 108 whether the recognizer 132 counts the banknotes, fed out from the banknote storage cassette 300 to the transport unit 130 of the banknote handling assembly 110.

Specifically, when the banknote storage cassette 300 is mounted to the cassette mounting arrangement 226 of the banknote handling assembly 210 in order to collect money from the money change machine 200 and banknotes are stored in the banknote storage cassette 300 (STEP1 and STEP2), if abnormality such as jamming phenomenon of the banknote occurs in the banknote handling assembly 210, information indicating that abnormality has occurred in the money change machine 200 is written in the storage medium 304 by the writing unit 228 of the banknote handling assembly 210. In this case, the state detector 107 detects occurrence of abnormality in the money change machine 200 based on the information read from the storage medium 304 by the reader 129. When it is detected by the state detector 107 that abnormality has occurred in the money change machine 200, it is determined by the determiner 108 that the banknotes fed out from the banknote storage cassette 300 to the transport unit 130 of the banknote handling assembly 110 are counted by the recognizer 132 ("YES" in STEP9). In this case, the banknotes fed out from the banknote storage cassette 300 to the transport unit 130 of the banknote handling assembly 110 are counted by the recognizer 132 and then stored in each banknote storage unit 134, 136 or collection cassette 140 (STEP10). In the banknote handling assembly 210 of the money change machine 200, if abnormality such as jamming phenomenon of the banknote has occurred, the information on the banknotes stored in the banknote storage cassette 300, recorded in the storage medium 304, may not be accurate. Therefore, by counting the banknotes fed out from the banknote storage cassette 300 to the transport unit 130 of the banknote handling assembly 110 by the recognizer 132, it is possible to reliably prevent occurrence of miscalculation in the money depositing and dispensing machine 100. When the information on the banknotes stored in each banknote storage unit 134, 136 or collection cassette 140 based on the banknote counting result by the recognizer 132 (for example, the number of the banknotes for each denomination or the monetary amount of the banknotes for each denomination) is different from the information on the banknotes stored in the banknote storage cassette 300 in the money change machine 200, read from the storage medium 304 by the reader 129, a warning message informing that miscalculation has occurred in the banknote handling assembly 110 is displayed on the operation/display unit 104 of the money depositing and dispensing machine 100.

On the other hand, when the banknote storage cassette 300 is mounted to the cassette mounting arrangement 226 of the banknote handling assembly 210 in order to collect money from the money change machine 200 and banknotes are stored in the banknote storage cassette 300 (STEP1 and STEP2), if abnormality such as jamming phenomenon of the banknote does not occur in the banknote handling assembly 210 and the information indicating that abnormality has occurred in the money change machine 200 is not written in the storage medium 304 by the writing unit 228 of the banknote handling assembly 210, the state detector 107 detects that no abnormality has occurred in the money change machine 200 based on the information read from the storage medium 304 by the reader 129. Then, when it is detected by the state detector 107 that there is no abnormality in the money change machine 200, it is determined by the determiner 108 that the banknotes fed out from the banknote storage cassette 300 to the transport unit 130 of the banknote handling assembly 110 are not counted by the recognizer 132 ("NO" in STEP9). In this case, the banknotes fed out from the banknote storage cassette 300 to the transport unit 130 of the banknote handling assembly 110 are not counted by the recognizer 132 but directly stored in each banknote storage unit 134, 136 or collection cassette 140 (STEP11). When the banknote storage cassette 300 is mounted to the cassette mounting arrangement 126 in the banknote handling assembly 110 of the money depositing and dispensing machine 100, the information on the banknotes stored in the banknote storage cassette 300 is read by the reader 129 provided in the cassette mounting arrangement 126. Therefore, even if the recognizer 132 does not count the banknotes fed out from the banknote storage cassette 300 to the transport unit 130 of the banknote handling assembly 110, the information on the banknotes stored in the banknote handling assembly 110 (specifically, the number of banknotes for each denomination or the monetary amount of the banknotes for each denomination) can be managed by the money depositing and dispensing machine 100. In addition, when no abnormality such as jamming phenomenon of the banknote has occurred in the banknote handling assembly 210 of the money change machine 200, the possibility that the information on the banknotes stored in the banknote storage cassette 300 recorded in the storage medium 304 is high. For this reason, even if the recognizer 132 does not count the banknotes fed out from the banknote storage cassette 300 to the transport unit 130 of the banknote handling assembly 110, miscalculation may not occur in the money depositing and dispensing machine 100. In this way, if it is not necessary to count the banknotes by the recognizer 132, omitting the counting process of the banknotes by the recognizer 132 can improve the processing efficiency of the banknotes in the banknote handling assembly 110 and shorten the processing time.

Further, as described above, the component-operation detector 310 is provided in the banknote storage cassette 300 and the component-operation detector 310 detects that each component of the banknote storage cassette 300 (specifically, the door (not shown) of the banknote storage cassette 300, the banknote feeding mechanism 306, the pantograph 309 and the like) is operated. In addition, information detected by the component-operation detector 310 is recorded in the storage medium 304. When the banknote storage cassette 300 is mounted to the cassette mounting arrangement 126 in the banknote handling assembly 110 of the money depositing and dispensing machine 100 (STEP6), if the information that some component of the banknote storage cassette 300 has been operated is read from the storage medium 304 by the reader 129, the state detector 107 detects that physical abnormality has occurred in the banknote storage cassette 300 itself. In this case, it is determined by the determiner 108 that the banknotes fed out from the banknote storage cassette 300 to the transport unit 130 of the banknote handling assembly 110 are counted by the recognizer 132 ("YES" in STEP9). If it is detected by the component-operation detector 310 that some component of the banknote storage cassette 300 has been operated, there is a possibility that the banknotes may be illegally extracted from the banknote storage cassette 300 by a malicious third party or the like. Further, if the banknotes are illegally extracted from the banknote storage cassette 300, the information on the banknotes stored in the banknote storage cassette 300, which is read from the storage medium 304 by the reader 129, may become inaccurate. Therefore, when the state detector 107 detects that some component of the banknote storage cassette 300 has been operated, by counting the banknotes fed out from the banknote storage cassette 300 to the transport unit 130 of the banknote handling assembly 110 by the recognizer 132, it is possible to prevent occurrence of miscalculation in the money depositing and dispensing machine 100.

In the above description, an example in which the component-operation detector 310 for detecting that some component of the banknote storage cassette 300 (specifically, the door (not shown) of the banknote storage cassette 300, the banknote feeding mechanism 306, the pantograph 309 and the like) has been operated is disposed at the banknote storage cassette 300 has been described. However, a component-operation detector (not shown) for detecting operation of each component of the banknote storage cassette 300 may be provided in the banknote handling assembly 110 of the money depositing and dispensing machine 100 instead of the banknote storage cassette 300. More specifically, when the banknote storage cassette 300 is mounted to the cassette mounting arrangement 126 of the banknote handling assembly 110 (STEP6), if some component of the banknote storage cassette 300 has been operated for illegally extracting the banknotes from the banknote storage cassette 300, it is detected by the detector provided in the banknote handling assembly 110 that some component of the banknote storage cassette 300 has been operated. Also in this case, the state detector 107 detects that physical abnormality has occurred in the banknote storage cassette 300 itself. And then, based on the information detected by the state detector 107, it is determined by the determiner 108 that the banknotes fed out from the banknote storage cassette 300 to the transport unit 130 of the banknote handling assembly 110 are counted by the recognizer 132 ("YES" in STEP9).

When the banknote storage cassette 300 is mounted to the cassette mounting arrangement 226 of the banknote handling assembly 210 in order to collect money from money change machine 200 and banknotes are stored in the banknote storage cassette 300 (STEP1 and STEP2), information on the banknotes stored in the banknote storage cassette 300 is written in the storage medium 304 by the writing unit 228. At this time, if a writing error occurs or information on the banknotes stored in the banknote storage cassette 300 is not written in the storage medium 304 by the writing unit 228, an abnormality of a writing in the storage medium 304 is detected by the state detector 107 or it is detected by the state detector 107 that the information on the banknotes stored in the banknote storage cassette 300 is not recorded in the storage medium 304 although the banknotes are actually stored in the banknote storage cassette 300, when the banknote storage cassette 300 is mounted to the cassette mounting arrangement 126 of the banknote handling assembly 110 and the information is read from the storage medium 304 by the reader 129. In this case, based on the information detected by the state detector 107, it is also determined by the determiner 108 that the banknotes fed out from the banknote storage cassette 300 to the transport unit 130 of the banknote handling assembly 110 are counted by the recognizer 132 ("YES" in STEP9).

In the present embodiment, even if it is determined by the determiner 108 that the banknotes fed out from the banknote storage cassette 300 to the transport unit 130 of the banknote handling assembly 110 are not counted by the recognizer 132 based on the information detected by the state detector 107 ("YES" in STEP9), there is a case that the recognizer 132 counts the banknotes fed out from the banknote storage cassette 300 to the transport unit 130 of the banknote handling assembly 110 at random (specifically, for example, once every several times), in order to prevent illegal act such as withdrawal of the banknotes from banknote storage cassette 300. When the information on the banknotes stored in each banknote storage unit 134, 136 or collection cassette 140 based on the banknote counting result by the recognizer 132 (for example, the number of the banknotes for each denomination or the monetary amount of the banknotes for each denomination) is different from the information on the banknotes stored in the banknote storage cassette 300 in the money change machine 200, read from the storage medium 304 by the reader 129, a warning message informing that miscalculation has occurred in the banknote handling assembly 110 is displayed in the operation/display unit 104 of the money depositing and dispensing machine 100. By performing such an operation, since the banknotes fed out from the banknote storage cassette 300 to the transport unit 130 of the banknote handling assembly 110 are randomly counted by the recognizer 132, it is possible to exert suppression effect of illegal act such as withdrawal of the banknotes from banknote storage cassette 300.

In the money depositing and dispensing machine 100 (money handling apparatus) of the present embodiment having the above configuration, the money management system 1 including such money depositing and dispensing machine 100, and the money handling method conducted by such money depositing and dispensing machine 100, the state detector 107 for detecting the state of another apparatus (specifically, the money change machine 200) to which the banknote storage cassette 300 has already been mounted or the state of the banknote storage cassette 300 itself is disposed. Further, based on the state detected by the state detector 107, the determiner 108 determines whether the recognizer 132 functioning as a counter counts the banknotes taken out from the banknote storage cassette 300. Therefore, if it is not necessary to count the banknotes taken out from the banknote storage cassette 300 by the recognizer 132, it is possible to omit the banknote counting process by the recognizer 132, thereby improving the processing efficiency and shortening the processing time.

Further, in the money depositing and dispensing machine 100 of the present embodiment, as described above, the state of another apparatus (specifically, the money change machine 200) to which the banknote storage cassette 300 has already been mounted or the state of the banknote storage cassette 300 itself is recorded in the storage medium 304. Based on the information read from the storage medium 304 by the reader 129, the state detector 107 detects the state of another apparatus to which the banknote storage cassette 300 has already been mounted or the state of the banknote storage cassette 300 itself. In this case, even if the money depositing and dispensing machine 100 of the present embodiment and another apparatus are not communicably connected via a LAN or the like, information on the state of another apparatus or information on the banknote storage cassette 300 itself can be managed by the money depositing and dispensing machine 100.

Further, in the money depositing and dispensing machine 100 of the present embodiment, as described above, the state detector 107 detects an abnormality of the another apparatus (specifically, the money change machine 200). In this case, the state detector 107 detects whether a jamming phenomenon of money (specifically, banknote) has occurred as the abnormality of the another apparatus. When it is detected by the state detector 107 that abnormality has occurred in another apparatus, the information on the banknotes stored in the banknote storage cassette 300, recorded in the storage medium 304, may not be accurate. However, according to the above technical matters, since the determiner 108 determines that the banknotes taken out from the banknote storage cassette 300 are counted by the recognizer 132 functioning as a counter, it is possible to reliably prevent occurrence of miscalculation in the money depositing and dispensing machine 100.

Further, in the money depositing and dispensing machine 100 of the present embodiment, as described above, the state detector 107 detects that some component of the banknote storage cassette 300 has been operated. In this case, the component-operation detector 310 for detecting operation of each component of the banknote storage cassette 300 may be disposed at the banknote storage cassette 300 and the state detector 107 may detect that some component of the banknote storage cassette 300 has been operated based on the information detected by the component-operation detector 310. If it is detected by the component-operation detector 310 that some component of the banknote storage cassette 300 has been operated, there is a possibility that the banknotes may be illegally extracted from the banknote storage cassette 300 by a malicious third party or the like. Further, if the banknotes are illegally extracted from the banknote storage cassette 300, the information on the banknotes stored in the banknote storage cassette 300, which is read from the storage medium 304 by the reader 129, may become inaccurate. Therefore, when the state detector 107 detects that some component of the banknote storage cassette 300 has been operated, by counting the banknotes fed out from the banknote storage cassette 300 to the transport unit 130 of the banknote handling assembly 110 by the recognizer 132, it is possible to prevent occurrence of miscalculation in the money depositing and dispensing machine 100.

Further, in the money depositing and dispensing machine 100 of the present embodiment, as described above, the state detector 107 may detect that some component of the banknote storage cassette 300 has been operated when the banknote storage cassette 300 is mounted to the cassette mounting arrangement 126. Specifically, instead of providing the component-operation detector 310 in the banknote storage cassette 300 to detect that some component of the banknote storage cassette 300 has been operated, a component-operation detector (not shown) may be provided in the money depositing and dispensing machine 100 to detect that some component of the banknote storage cassette 300 has been operated. Also in this case, when the state detector 107 detects that some component of the banknote storage cassette 300 has been operated, by counting the banknotes fed out from the banknote storage cassette 300 to the transport unit 130 of the banknote handling assembly 110 by the recognizer 132, it is possible to prevent occurrence of miscalculation in the money depositing and dispensing machine 100.

Further, in the money depositing and dispensing machine 100 of the present embodiment, as described above, the state detector 107 detects that there is error of writing in the storage medium 304 or that information on the money (specifically, banknotes) stored in the banknote storage cassette 300 is not recorded in the storage medium 304 even though the money is actually stored in the banknote storage cassette 300.

Further, in the money depositing and dispensing machine 100 of the present embodiment, as described above, the counter for counting the banknotes consists of the recognizer 132 for recognizing the banknotes. However, the money depositing and dispensing machine 100 according to the present embodiment is not limited to such an aspect. As a counter for counting the banknotes, one other than the recognizer 132 may be used.

The money management system 1 according to the present embodiment, the money handling method, and the money depositing and dispensing machine 100 and the money change machine 200 disposed in the money management system 1 are not limited to the above-described aspect, and various modifications can be made.

For example, when the banknote storage cassette 300 is mounted to the cassette mounting arrangement 226 of the banknote handling assembly 210 in the money change machine 200 and banknotes are stored in the banknote storage cassette 300, if the banknotes stored in this banknote storage cassette 300 are only the banknotes of specific denomination to be stored in the collection cassette 140 of the money depositing and dispensing machine 100 (specifically, 10,000-yen banknote), instead of counting the banknotes fed out from the banknote storage cassette 300 in the money depositing and dispensing machine 100 by the recognizer 132, the banknotes fed out from the banknote storage cassette 300 may be sent directly to the collection cassette 140 of the money depositing and dispensing machine 100. More specifically, as described above, in the money change machine 200 of the present embodiment, when the banknote storage cassette 300 is mounted to the cassette mounting arrangement 226 of the banknote handling assembly 210 and the banknotes are stored in the banknote storage cassette 300, information such as the number of banknotes stored in the banknote storage cassette 300 for each denomination and the like is written in the storage medium 304 by the writing unit 228 (STEP3 in FIG. 14). Also, when the banknote storage cassette 300 is mounted to the cassette mounting arrangement 126 in the banknote handling assembly 110 of the money depositing and dispensing machine 100, the information recorded in the storage medium 304 (in this case, the information that the banknotes stored in the banknote storage cassette 300 are only 10,000-yen banknotes) is read by the reader 129 provided in the cassette mounting arrangement 126 (STEP7). That is, in the above case, based on the information read by the reader 129 provided in the cassette mounting arrangement 126, it is detected that all the banknotes fed out from the banknote storage cassette 300 are to be stored in the collection cassette 140. Based on this detected state, it is determined that the recognizer 132 does not count the banknotes fed out from the banknote storage cassette 300 to the transport unit 130 of the banknote handling assembly 110. This makes it possible to improve the processing efficiency of the banknotes in the banknote handling assembly 110, thus making it possible to shorten the processing time of the banknotes.

In addition, when both the banknote storage unit 134 (specifically, corresponding to 1,000-yen banknote) and the banknote storage unit 136 (specifically, corresponding to 5,000-yen banknote) of the banknote handling assembly 110 are in the full state (that is, the state where the banknotes are stored up to the limit of the storage amount of the banknotes in each banknote storage unit 134, 136), the following operation may be performed. When the banknote storage cassette 300 is mounted to the cassette mounting arrangement 126 in the banknote handling assembly 110 of the money depositing and dispensing machine 100, the counting process of the banknotes fed out from the banknote storage cassette 300 to the transport unit 130 of the banknote handling assembly 110 by the recognizer 132 is omitted, and the banknotes fed out from the banknote storage cassette 300 are directly sent to the collection cassette 140. Also in this case, omitting the counting process of the banknotes fed out from the banknote storage cassette 300 to the transport unit 130 of the banknote handling assembly 110 can improve the processing efficiency of the banknotes in the banknote handling assembly 110 and shorten the processing time.

Also, if denominations of the banknotes stored in the banknote storage cassette 300 does not include 5,000-yen, and the banknote storage unit 134 (specifically, corresponding to 1,000-yen banknote) of the banknote handling assembly 110 is in the full state, the following operation may be performed. When the banknote storage cassette 300 is mounted to the cassette mounting arrangement 126 in the banknote handling assembly 110 of the money depositing and dispensing machine 100, the counting process of the banknotes fed out from the banknote storage cassette 300 to the transport unit 130 of the banknote handling assembly 110 by the recognizer 132 is omitted, and the banknotes fed out from the banknote storage cassette 300 are sent directly to the collection cassette 140. Further, if denominations of the banknotes stored in the banknote storage cassette 300 does not include 1,000-yen, and the banknote storage unit 136 (specifically, corresponding to the 5,000-yen banknote) of the banknote handling assembly 110 is in the full state, the following operation may be performed. When the banknote storage cassette 300 is mounted to the cassette mounting arrangement 126 in the banknote handling assembly 110 of the money depositing and dispensing machine 100, the counting process of the banknotes fed out from the banknote storage cassette 300 to the transport unit 130 of the banknote handling assembly 110 by the recognizer 132 is omitted, and the banknotes fed out from the banknote storage cassette 300 are directly sent to the collection cassette 140. Also in those cases, omitting the counting process of the banknotes fed out from the banknote storage cassette 300 to the transport unit 130 of the banknote handling assembly 110 can improve the processing efficiency of the banknotes in the banknote handling assembly 110 and shorten the processing time.

As described above, in the banknote storage unit 236 of the banknote handling assembly 210 of the money change machine 200, 2,000-yen banknotes and 5,000-yen banknotes are stored in a mixed state. For this reason, the banknotes fed out from the banknote storage unit 236 and stored in the banknote storage cassette 300 may be in a mixed state of 2,000-yen banknotes and 5,000-yen banknotes. In such a case, if denominations of the banknotes stored in the banknote storage cassette 300 does not include 1,000-yen, and the banknote storage unit 136 (specifically, corresponding to 5,000-yen banknote) of the banknote handling assembly 110 is in the full state, the following operation may be performed. When the banknote storage cassette 300 is mounted to the cassette mounting arrangement 126 in the banknote handling assembly 110 of the money depositing and dispensing machine 100, the counting process of the banknotes fed out from the banknote storage cassette 300 to the transport unit 130 of the banknote handling assembly 110 by the recognizer 132 is omitted, and the banknotes fed out from the banknote storage cassette 300 are directly sent to the collection cassette 140. This makes it possible to improve the processing efficiency of the banknotes in the banknote handling assembly 110 and shorten the processing time of the banknotes.

Also, when the banknote storage cassette 300 is mounted to the cassette mounting arrangement 226 of the banknote handling assembly 210 and banknotes are stored in banknote storage cassette 300, information associating order of storing each banknote in the banknote storage cassette 300 with the denomination of each banknote may be written in the storage medium 304 by the writing unit 228 of the money change machine 200. In this case, even when the banknotes in a state in which a plurality of denominations thereof are mixed are stored in the banknote storage cassette 300, counting process of the banknotes fed out from the banknote storage cassette 300 to the transport unit 130 of the banknote handling assembly 110 by the recognizer 132 can be omitted. As an example of performing such operation, a case where the banknotes are stored in the banknote storage cassette 300 in the order of 1,000-yen banknotes, 5,000-yen banknotes, and 10,000-yen banknote in the money change machine 200, and then the banknotes fed out from the banknote storage cassette 300 are stored in the banknote storage units 134, 136 and the collection cassette 140 of the money depositing and dispensing machine 100 will be described. In this case, based on the information written in the storage medium 304, it can be determined that the banknotes which are fed out first are 1,000-yen banknotes. For this reason, it is possible to store the banknotes taken out from the banknote storage cassette 300 in the banknote storage unit 134 (corresponding to 1,000-yen banknote) without counting the banknotes by the recognizer 132. Also, based on the information written in the storage medium 304, it can be determined that the banknotes to be fed out next to the 1,000-yen banknotes are 5,000-yen banknotes. For this reason, it is possible to store the banknotes taken out from the banknote storage cassette 300 in the banknote storage unit 136 (corresponding to 5,000-yen banknote) without counting the banknotes by the recognizer 132. Similarly, based on the information written in the storage medium 304, it can be determined that the banknotes to be fed out next to the 5,000-yen banknotes are 10,000-yen banknotes. For this reason, it is possible to store the banknotes taken out from the banknote storage cassette 300 in the collection cassette 140 without counting the banknotes by the recognizer 132. By performing the above operation, it is possible to omit the counting process of the banknotes fed out from the banknote storage cassette 300 to the transport unit 130 of the banknote handling assembly 110 so that the processing efficiency of the banknotes in the banknote handling assembly 110 can be improved and the processing time of the banknotes can be shortened.

Note that the money change machine 200 according to the present embodiment can also function as a change machine even in a state where the banknote storage cassette 300 is mounted to the cassette mounting arrangement 226 of the banknote handling assembly 210. In this case, when at least one banknote storage unit of each banknote storage unit 234, 236, 238 of money change machine 200 becomes full state, if a banknote corresponding to the full state banknote storage unit is deposited, the deposited banknote is stored in the banknote storage cassette 300. Even in such an operation, as described above, the order of storing each banknote in the banknote storage cassette 300 and the denomination of each banknote are recorded in the storage medium 304 of the banknote storage cassette 300 in association with each other. Thus, it is possible to omit the counting process of the banknotes fed out from the banknote storage cassette 300 to the transport unit 130 of the banknote handling assembly 110 in the money depositing and dispensing machine 100, and then processing efficiency of the banknotes in banknote handling assembly 110 can be improved and processing time of the banknotes can be shortened.

In the money management system 1 according to a modified example, instead of writing various information such as information on the banknotes stored in the banknote storage cassette 300 and information on the state of the money change machine 200 in the storage medium 304 provided in the banknote storage cassette 300, these pieces of information may be written in an ID card carried by an operator such as a clerk. In the money management system 1 according to such a modification, when collecting money as proceeds from sales from the money change machine 200, the operator passes the ID card through the card reader 296 of the POS register 290. As a result, various information such as the information on the banknotes stored in the banknote storage cassette 300 and information on the state of the money change machine 200 are written in the ID card. Also, when depositing money as proceeds from sales collected from the money change machine 200 into the money depositing and dispensing machine 100, the operator passes the ID card through a card reader (not shown) provided in the money depositing and dispensing machine 100. As a result, various information such as the information on the banknotes stored in the banknote storage cassette 300 and the information on the state of the money change machine 200, which are recorded in the ID card, are read, and the read information is transmitted to the control unit 102. Then, the state detector 107 detects the state of the money change machine 200 based on the information read from the ID card by the card reader. Also, based on the state detected by the state detector 107, the determiner 108 determines whether the counter such as the recognizer 132 counts the banknotes taken out from the banknote storage cassette 300. As described above, in the money management system 1 according to the modification as described above, it is possible to exchange various information between the money depositing and dispensing machine 100 and the money change machine 200 without using the storage medium 304 provided in the banknote storage cassette 300.

The banknote storage cassette 300 in which banknotes are stored is not limited to a type in which banknotes are stored in a stacked state as shown in FIGS. 12 and 13. As a banknote storage cassette in which banknotes are stored, a tape winding style in which banknotes are stored by winding the banknotes on a drum with a tape may be used.

Furthermore, in the money management system 1 according to still another modification, instead of using the banknote storage cassette 300 for storing the banknotes and feeding out the banknotes stored therein, a coin storage cassette for storing coins and feeding out the coins stored therein may be detachably mounted to each of the money depositing and dispensing machine 100 and the money change machine 200. In addition, a storage medium having the same configuration as that of the storage medium 304 described above may be provided in the coin storage cassette that stores the coins. In this case, the coins can be transferred, by using such a coin storage cassette, between the money depositing and dispensing machine 100 and the money change machine 200, so that coins collected from the money change machine 200 as proceeds from sales or coins which are dispensed from the money depositing and dispensing machine 100 and with which the money change machine 200 is to be replenished as change replenishment money can be prevented from being touched by a hand of an operator, thereby enhancing security. In such a money management system 1, the banknotes as proceeds from sales collected from the banknote handling assembly 210 of the money change machine 200 are transferred by hand to the money depositing and dispensing machine 100 and then stored in the money depositing and dispensing machine 100.

In the money management system 1 according to still another modification in which such a coin storage cassette is used, the money change machine 200 may include a writing unit that writes various information such as information on the coins stored in the coin storage cassette and information on the state of the money change machine 200 (specifically, information as to whether abnormality such as jamming phenomenon of the coin occurs in the coin handling assembly 250 of the money change machine 200) in the storage medium provided in the coin storage cassette, when the coin storage cassette is mounted to money change machine 200. In addition, the money depositing and dispensing machine 100 may have a reader, a state detector, and a determiner. The reader reads information from the storage medium provided in the coin storage cassette when the coin storage cassette is mounted to the money depositing and dispensing machine 100. The state detector detects the state of the money change machine 200 or the coin storage cassette itself based on the information read by the reader. The determiner determines whether a counter such as the recognizer 156 counts the coins taken out from the coin storage cassette or not, based on the state detected by the state detector. Thus, when the coin storage cassette is mounted to the money change machine 200, various pieces of information such as information on the coins stored in the coin storage cassette and information on the state of the money change machine 200 are written in the storage medium disposed at the coin storage cassette. Further, when the coin storage cassette is mounted to the money depositing and dispensing machine 100, the state of the money change machine 200 is detected by the state detector based on the information read from the storage medium provided in the coin storage cassette. The determiner determines whether a counter, such as the recognizer 156, counts the coins taken out from the coin storage cassette or not, based on the state detected by the state detector. In such a money management system 1, when it is not necessary to count the coins taken out from the coin storage cassette using the counter such as the recognizer 156, it is possible to omit the counting process of the coins using the counter, and then processing efficiency of the coins can be improved and the processing time can be shortened.

The invention claimed is:

1. A money handling apparatus disposed at a commercial facility, the money handling apparatus comprising:

a mounting arrangement to which a storage cassette configured to be detachably mounted to another money handling apparatus and configured to store money stored in the another money handling apparatus is mountable, the storage cassette being provided with a storage medium in which at least information on the money stored in the storage cassette is recorded by the another money handling apparatus, the another money handling apparatus being disposed at the commercial facility and connected to a point of sales register disposed at the commercial facility;

a reader configured to read information from the storage medium of the storage cassette mounted to the mounting arrangement;

a counter configured to count the money;

a state detector configured to detect a state of the another money handling apparatus to which the storage cassette has previously been mounted, based on the information read from the storage medium by the reader;

a monitor; and a determiner configured to determine whether the counter counts the money taken out from the storage cassette, based on the state detected by the state detector, wherein the determiner determines not to count the money by the counter when the state detector detects that there is no abnormality in the another money handling apparatus, and the monitor displays a counting result acquired by the counter when the counter counts the money taken out from the storage cassette.

2. The money handling apparatus according to claim 1, wherein the state of the another money handling apparatus to which the storage cassette has previously been mounted is recorded in the storage medium by the another money handling apparatus, and the state detector detects the state of the another money handling apparatus to which the storage cassette has previously been mounted, based on the information read from the storage medium by the reader.

3. The money handling apparatus according to claim 1, wherein the state detector detects whether a jamming of the money has occurred as the abnormality of the another money handling apparatus.

4. The money handling apparatus according to claim 1, wherein the state detector detects that a component of the storage cassette has been operated.

5. The money handling apparatus according to claim 4, wherein a component-operation detector configured to detect that the component of the storage cassette has been operated is disposed at the storage cassette, and the state detector detects that the component of the storage cassette has been operated based on information detected by the component-operation detector.

6. The money handling apparatus according to claim 4, wherein the state detector detects operation of the component of the storage cassette when the component of the storage cassette is operated while the storage cassette is mounted to the mounting arrangement.

7. The money handling apparatus according to claim 1, wherein the state detector is operable to detect an abnormality of a writing in the storage medium or to detect information on the money stored in the storage cassette is not recorded in the storage medium even though the money is stored in the storage cassette.

8. The money handling apparatus according to claim 1, wherein the counter includes a recognizer configured to recognize the money.

9. A money management system comprising:

a first money handling apparatus disposed at a commercial facility, connected to a point of sales register disposed at the commercial facility, and configured to perform at least money depositing;

a second money handling apparatus disposed at the commercial facility and configured to perform at least money dispensing; and a storage cassette configured to store money and configured to be detachably mounted to each of the first money handling apparatus and the second money handling apparatus, the storage cassette being configured to store money stored in the first money handling apparatus, wherein the storage cassette includes a storage medium in which at least information on the money stored in the storage cassette is recordable by the first money handling apparatus, and the second money handling apparatus comprises:

a reader configured to read information from the storage medium of the storage cassette mounted to the second money handling apparatus;

a counter configured to count the money;

a state detector configured to detect a state of the first money handling apparatus, based on the information read from the storage medium by the reader; and a determiner configured to determine whether the counter counts the money taken out from the storage cassette, based on the state detected by the state detector, wherein the determiner determines not to count the money by the counter when the state detector detects that there is no abnormality in the first money handling apparatus.

10. The money management system according to claim 9, wherein the state of the first money handling apparatus is recorded in the storage medium by the first money handling apparatus, and the state detector detects the state of the first money handling apparatus based on the information read from the storage medium by the reader.

11. A money handling method comprising:

mounting a storage cassette, which is configured to store money and feed out the stored money and wherein the storage cassette is provided with a storage medium in which at least information on the money stored in the storage cassette is recorded by a first money handling apparatus disposed at a commercial facility, to a mounting arrangement of a second money handling apparatus disposed at the commercial facility and connected to a point of sales register disposed at the commercial facility;

reading information from the storage medium of the storage cassette mounted to the mounting arrangement by a reader of the second money handling apparatus;

detecting a state of the first money handling apparatus to which the storage cassette has previously been mounted by a state detector of the second money handling apparatus; and determining, by a determiner of the second money handling apparatus, whether to count the money taken out from the storage cassette by a counter of the second money handling apparatus, based on the state detected by the state detector, wherein the determiner of the second money handling apparatus determines not to count the money by the counter when the state detector detects that there is no abnormality in the first money handling apparatus.

12. The money handling method according to claim 11, wherein the state of the first money handling apparatus to which the storage cassette has previously been mounted is recorded in the storage medium by the first money handling apparatus, and the state detector of the second money handling apparatus detects the state of the first money handling apparatus to which the storage cassette has previously been mounted, based on the information read from the storage medium by the reader.

* * * * *